US008139796B2

(12) United States Patent
Nakashima et al.

(10) Patent No.: US 8,139,796 B2
(45) Date of Patent: Mar. 20, 2012

(54) WIRELESS MICROPHONE DEVICE

(75) Inventors: Mitsuru Nakashima, Hyogo (JP); Koji Moriguchi, Hyogo (JP)

(73) Assignee: TOA Corporation, Hyogo (JP)

( * ) Notice: Subject to any disclaimer, the term of this patent is extended or adjusted under 35 U.S.C. 154(b) by 397 days.

(21) Appl. No.: 12/310,969

(22) PCT Filed: Sep. 10, 2007

(86) PCT No.: PCT/JP2007/067604

§ 371 (c)(1),
(2), (4) Date: Mar. 13, 2009

(87) PCT Pub. No.: WO2008/032683

PCT Pub. Date: Mar. 20, 2008

(65) Prior Publication Data

US 2009/0202087 A1 Aug. 13, 2009

(30) Foreign Application Priority Data

Sep. 13, 2006 (JP) ..... 2006-248553

(51) Int. Cl.
*H04R 25/00* (2006.01)

(52) U.S. Cl. ..... 381/189; 381/111

(58) Field of Classification Search ..... 381/189, 381/111

See application file for complete search history.

(56) References Cited

U.S. PATENT DOCUMENTS 5,471,658 A * 11/1995 Iacono ..... 455/128

FOREIGN PATENT DOCUMENTS

| | | | |
|---|---|---|---|
| JP | 03-135203 | A | 6/1991 |
| JP | 07-142921 | A | 6/1995 |
| JP | 09-098494 | A | 4/1997 |
| JP | 3227142 | B | 8/2001 |
| JP | 2004-242005 | A | 8/2004 |
| JP | 3640744 | B | 1/2005 |

OTHER PUBLICATIONS

International Search Report mailed Nov. 7, 2007.

* cited by examiner

*Primary Examiner* — Steven J Fulk
(74) *Attorney, Agent, or Firm* — Rader, Fishman & Grauer PLLC

(57) ABSTRACT

To provide a wireless microphone device that enables a circuit board, which is to be provided with an oscillation circuit, to be decreased in size without deteriorating radiation characteristics.

The wireless microphone device is configured to include: a circuit board 5 that is sectioned into circuit areas 11*a* and 11*b* and makes the respective circuit areas function as antenna elements of a dipole antenna; an oscillation circuit 21 that is arranged in the circuit area 11*b* and generates a high frequency signal on the basis of a voice signal from a microphone 2*a*; a feeding path for feeding the high frequency signal to an electrically conductive layer 11 in the circuit area 11*b* through a feeding point positioned on the circuit area 11*a* side distant from the oscillation circuit 21; and a high frequency shield covering at least a part of the feeding path. The high frequency shield is formed by covering the feeding path with a metal case 12 having an opening at a bottom face and conducting the metal case 12 to the electrically conducting layer 11 in the circuit area 11*b*.

17 Claims, 20 Drawing Sheets

【Fig. 1】
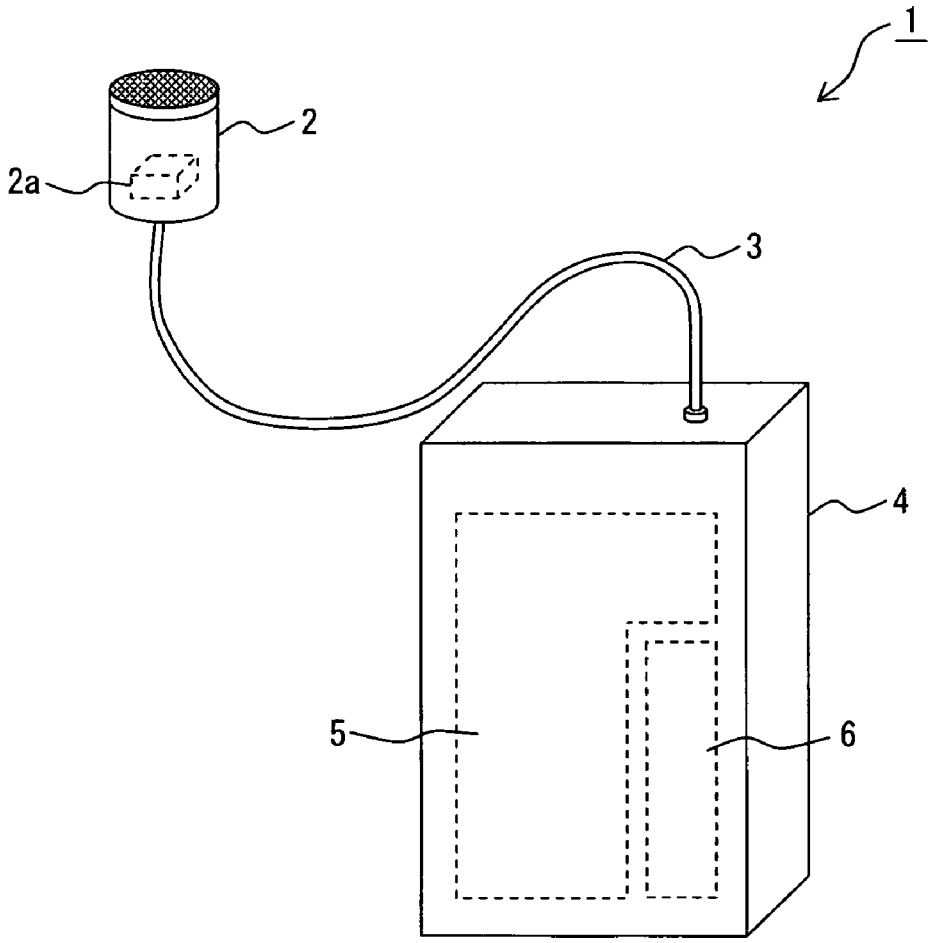

【Fig. 2】
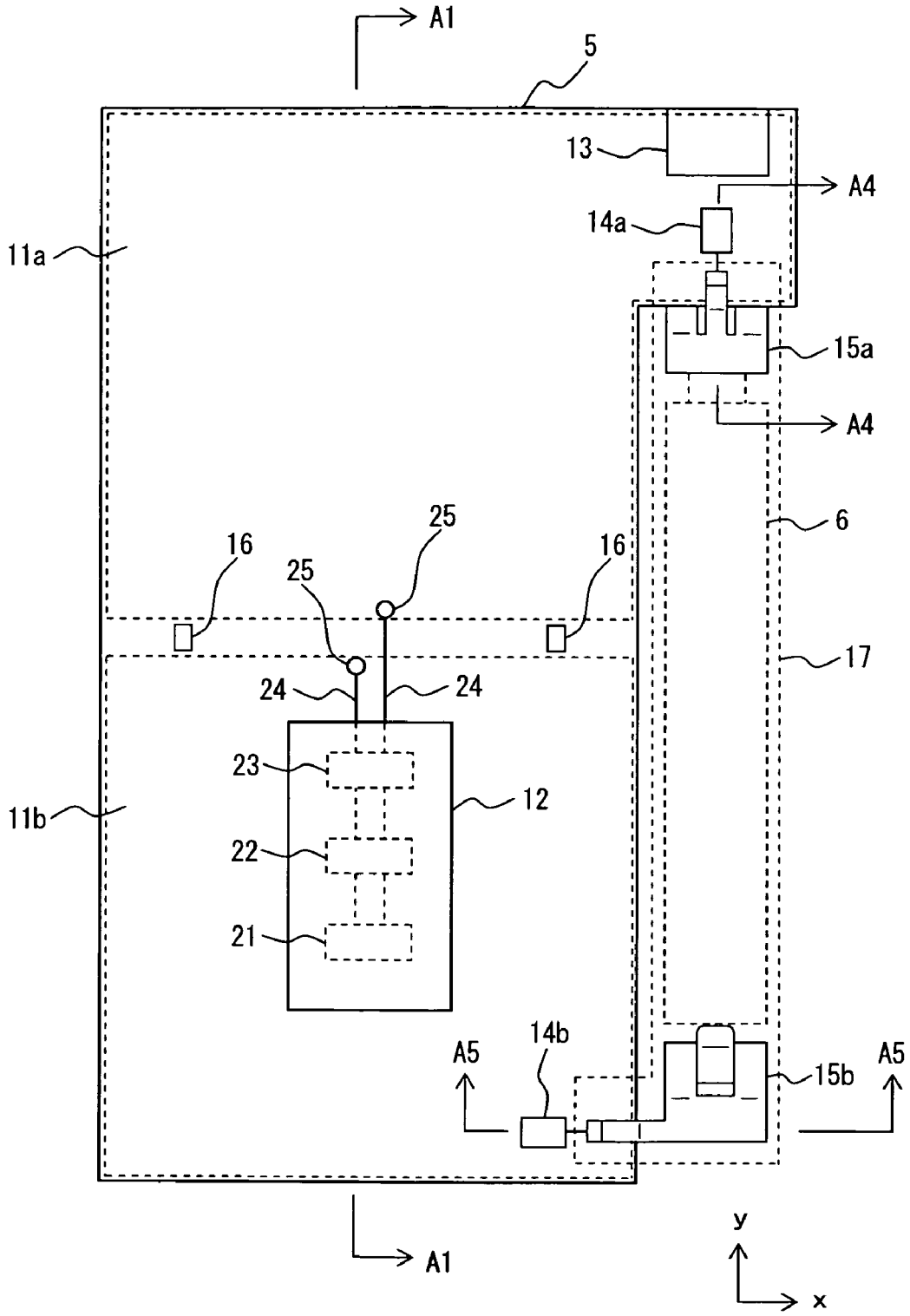

【Fig. 3】
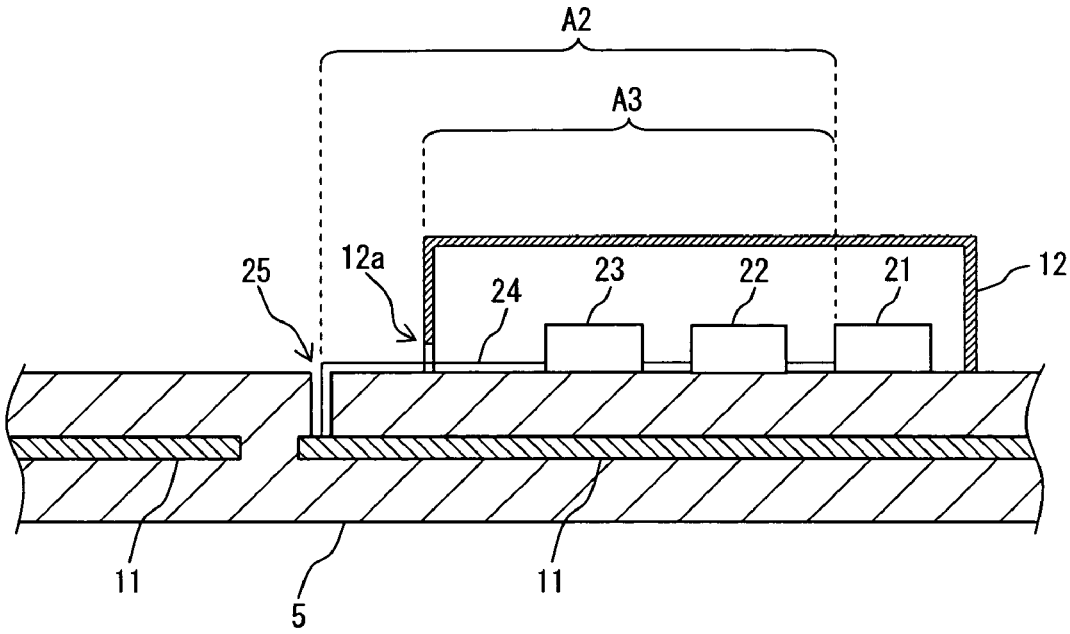

【Fig. 4】
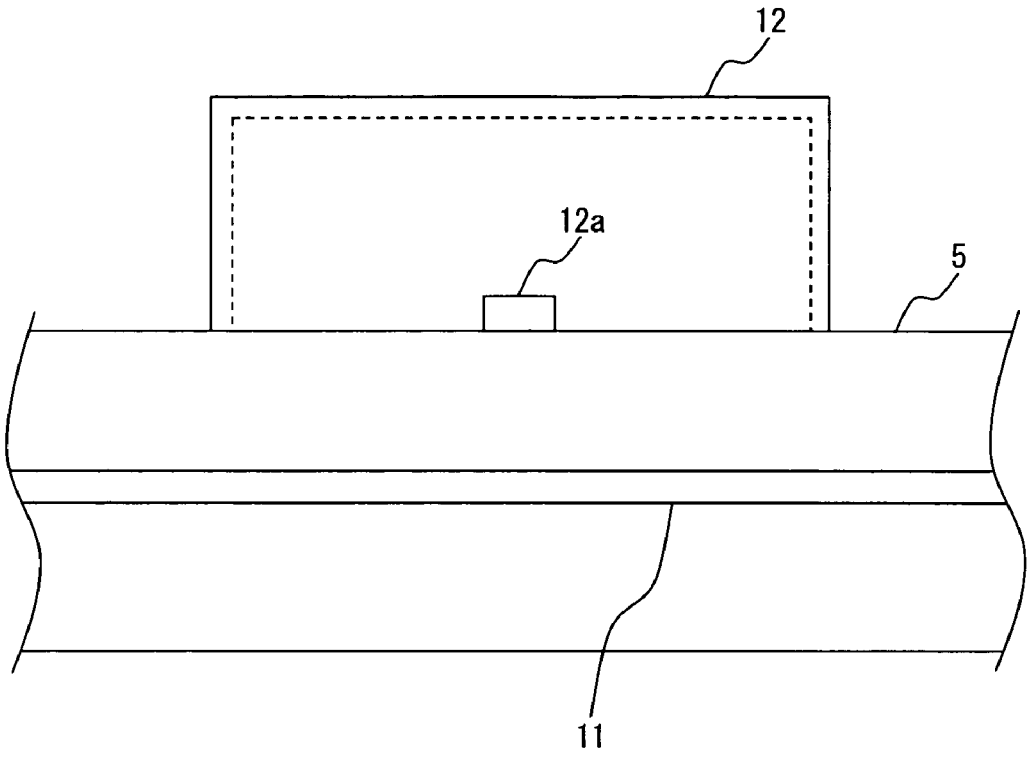

【Fig. 5】
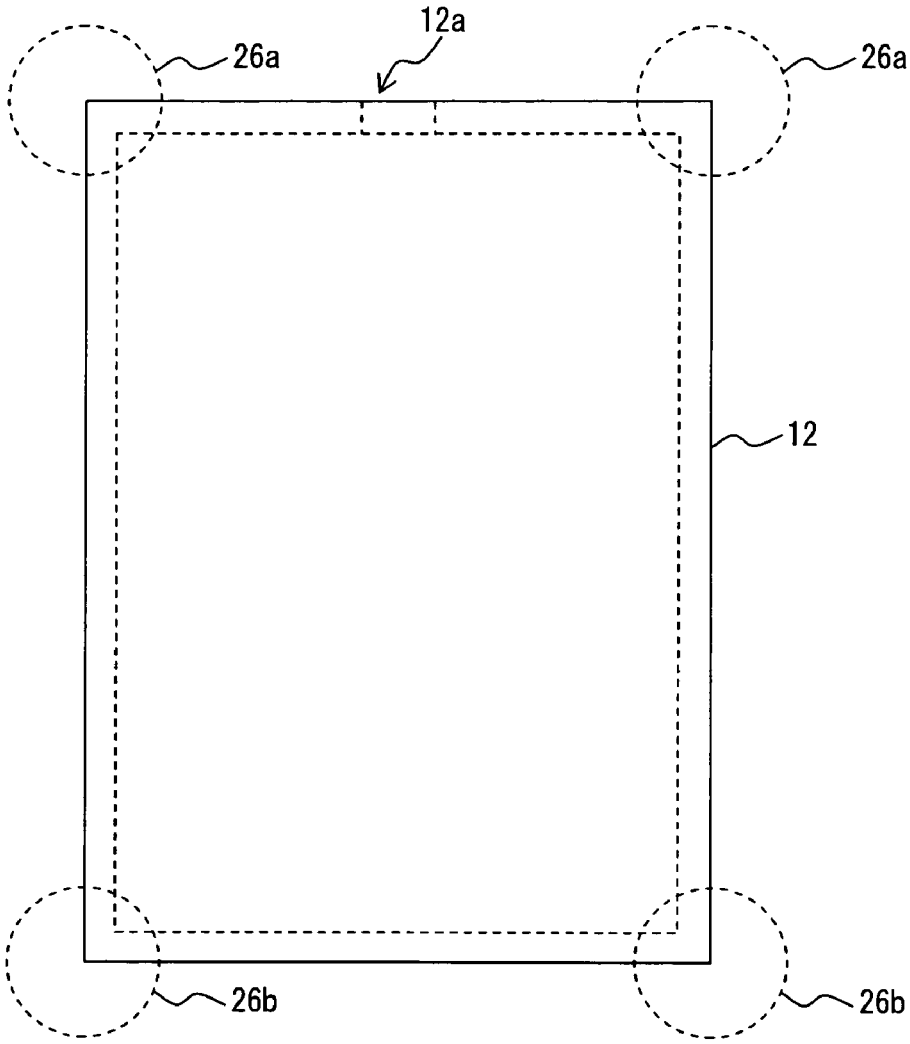

【Fig. 6】
(a)
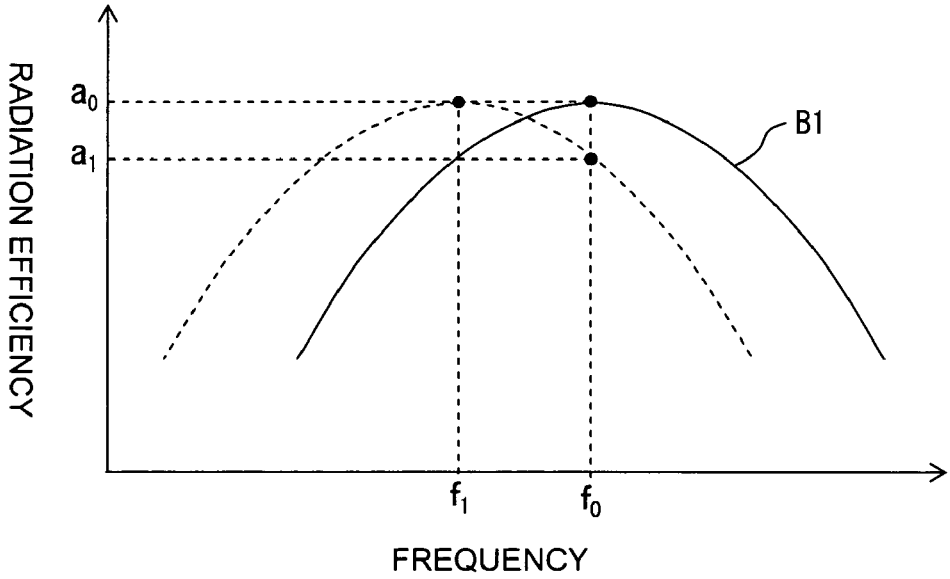
(b)
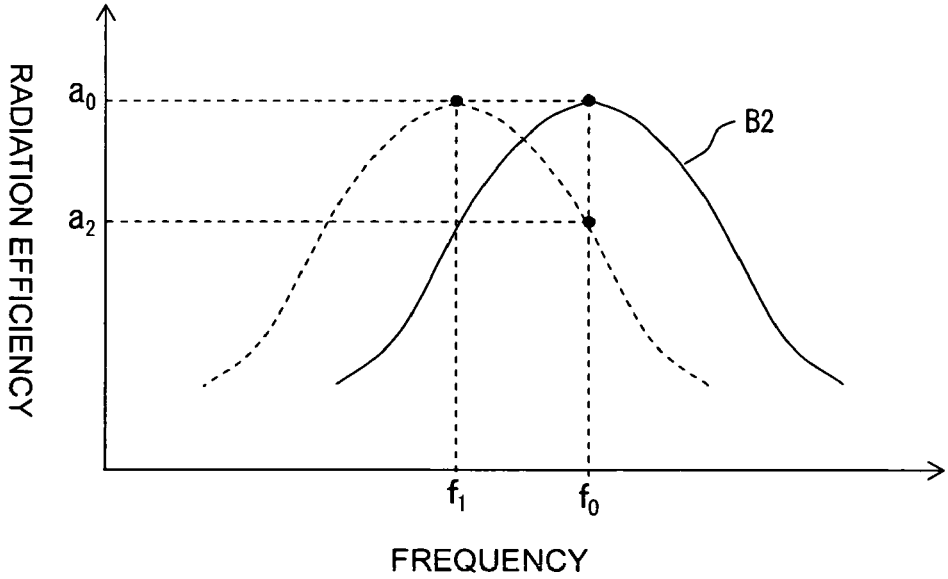

【Fig. 7】
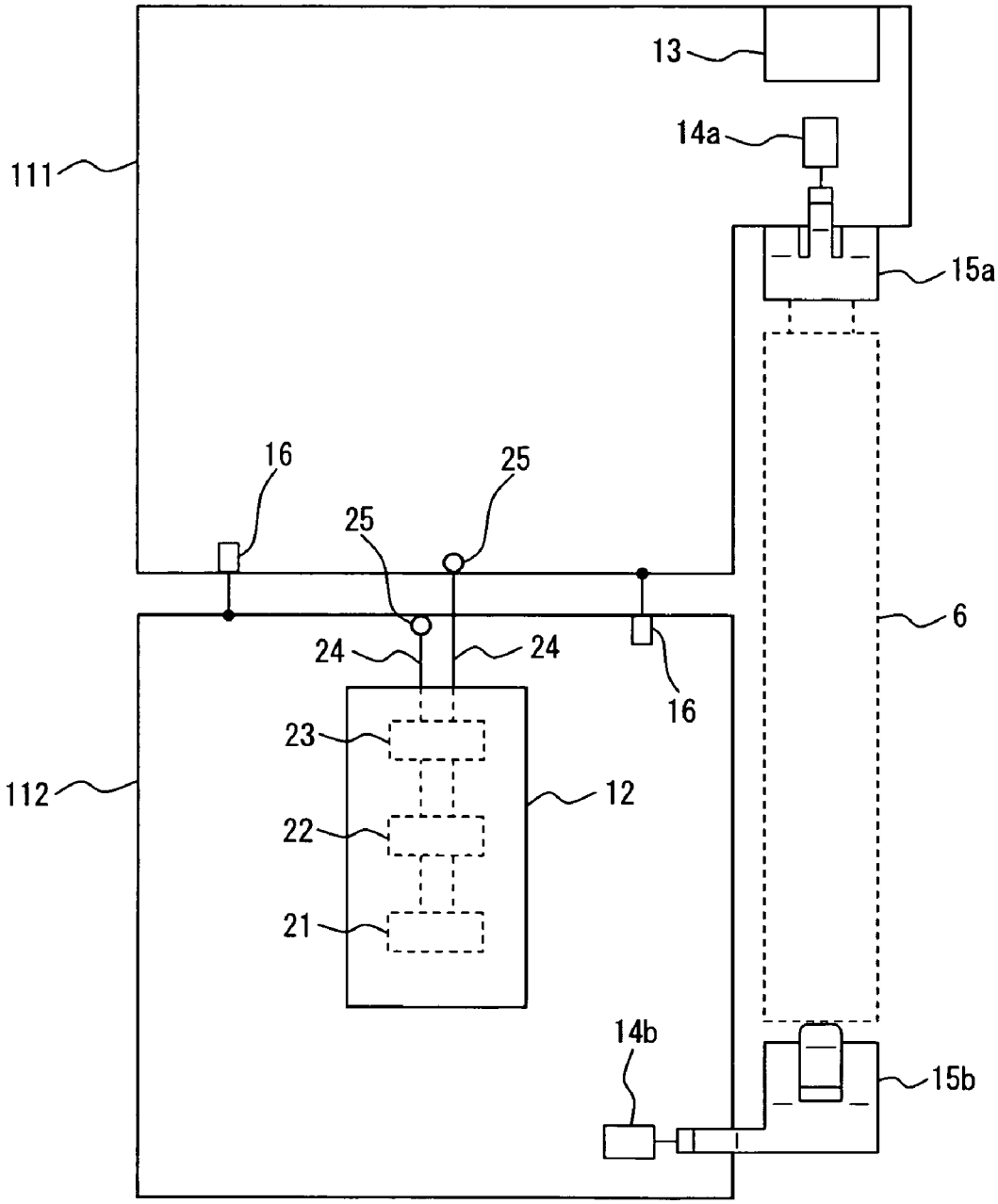

【Fig. 8】
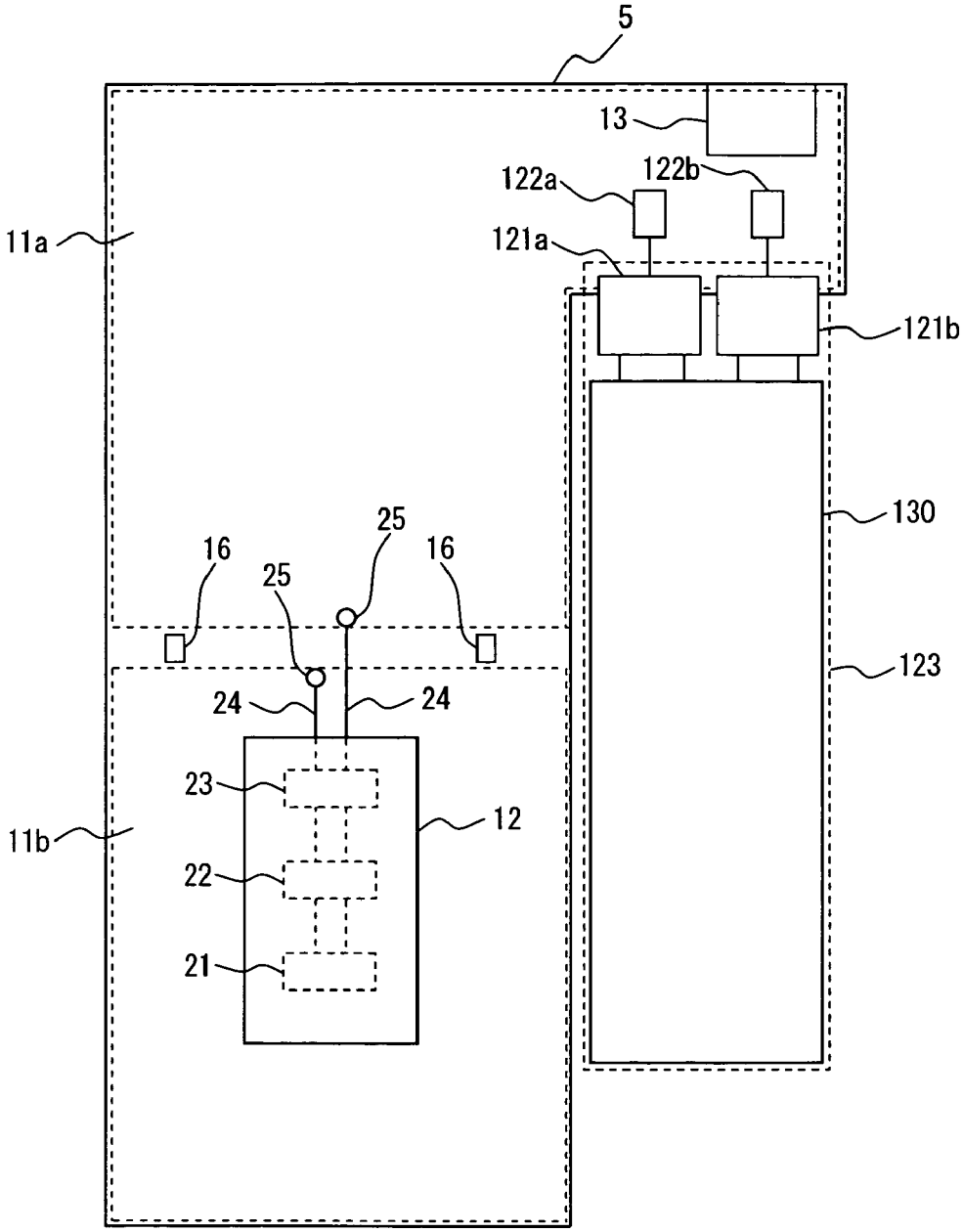

【Fig. 9】
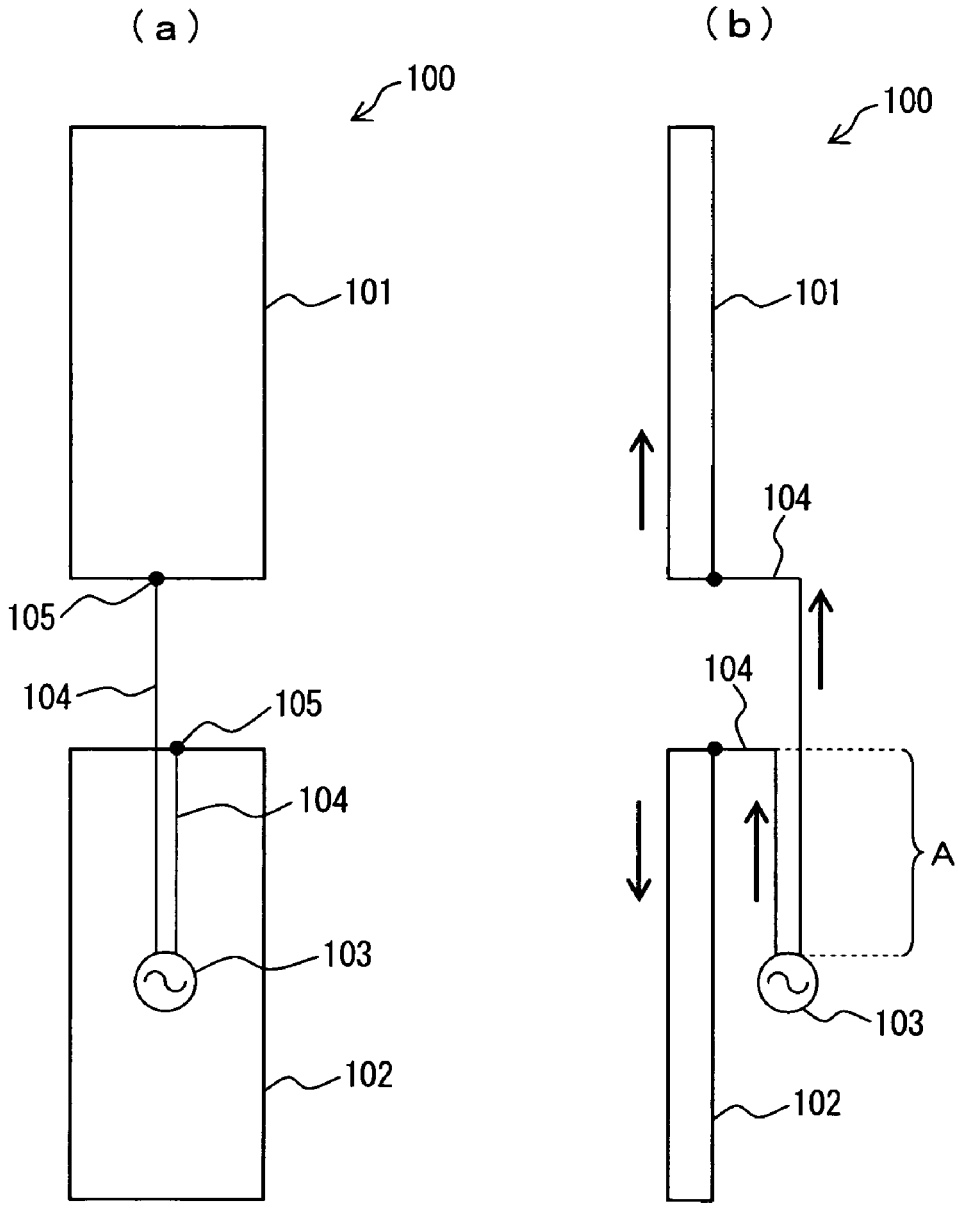

【Fig. 10】
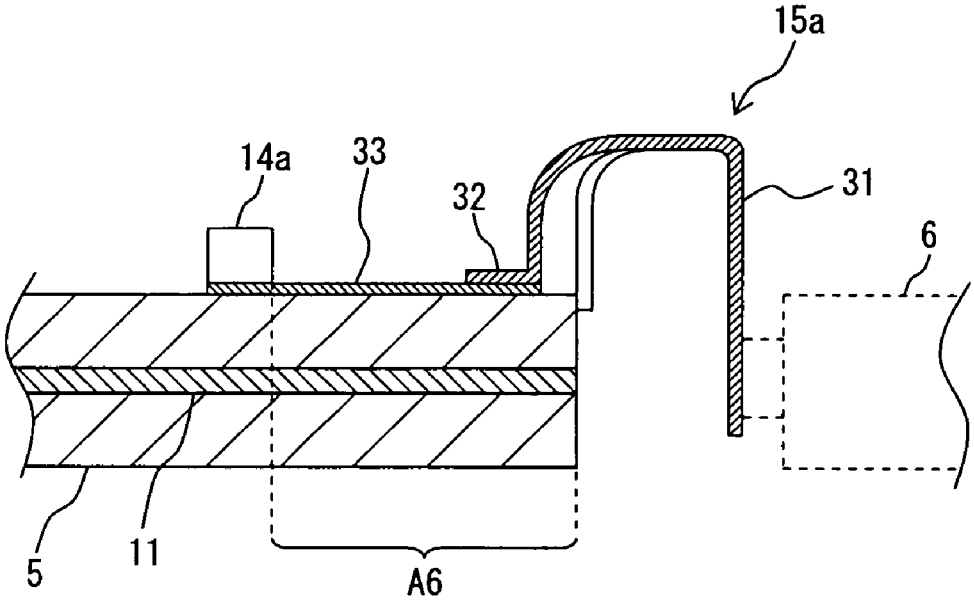

【Fig. 11】
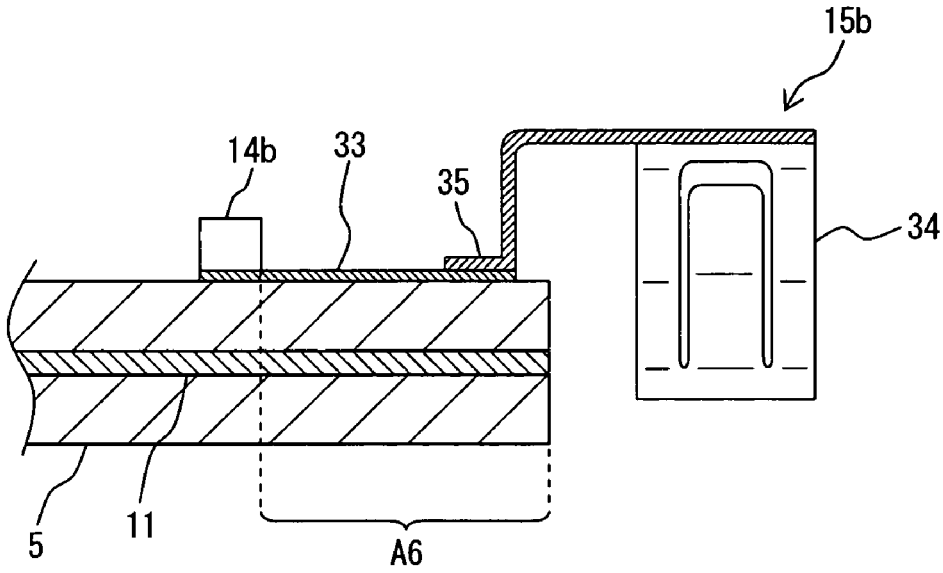

【Fig. 12】
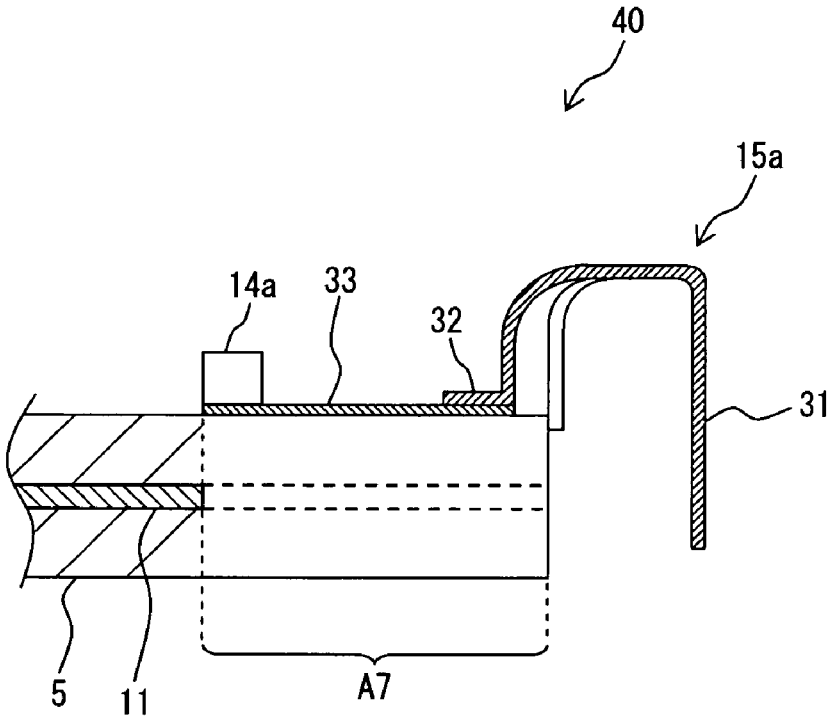

【Fig. 13】
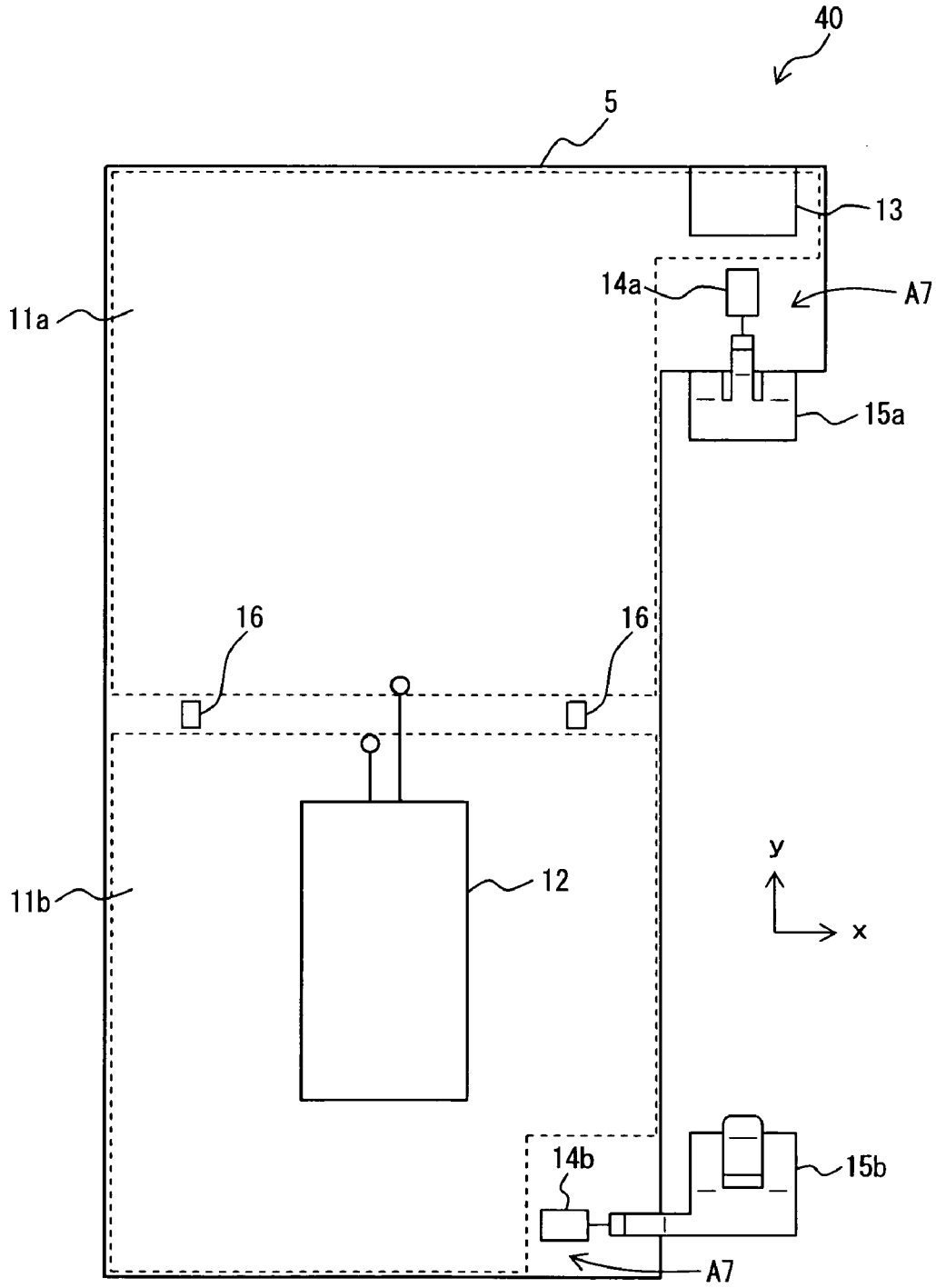

【Fig. 14】
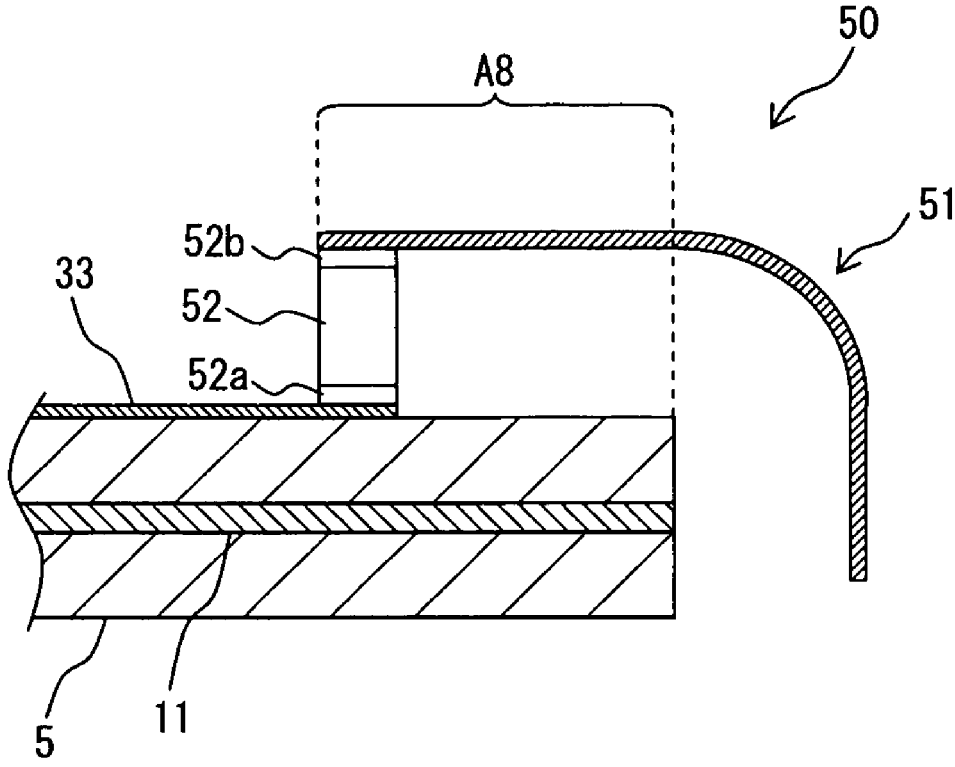

【Fig. 15】
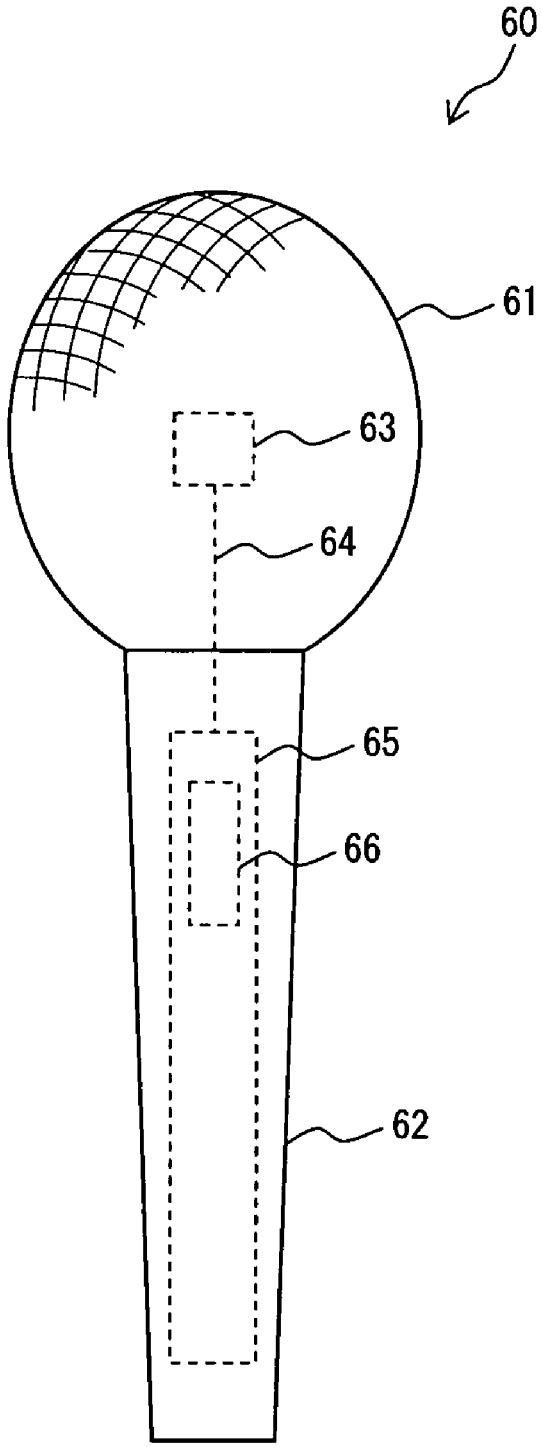

【Fig. 18】
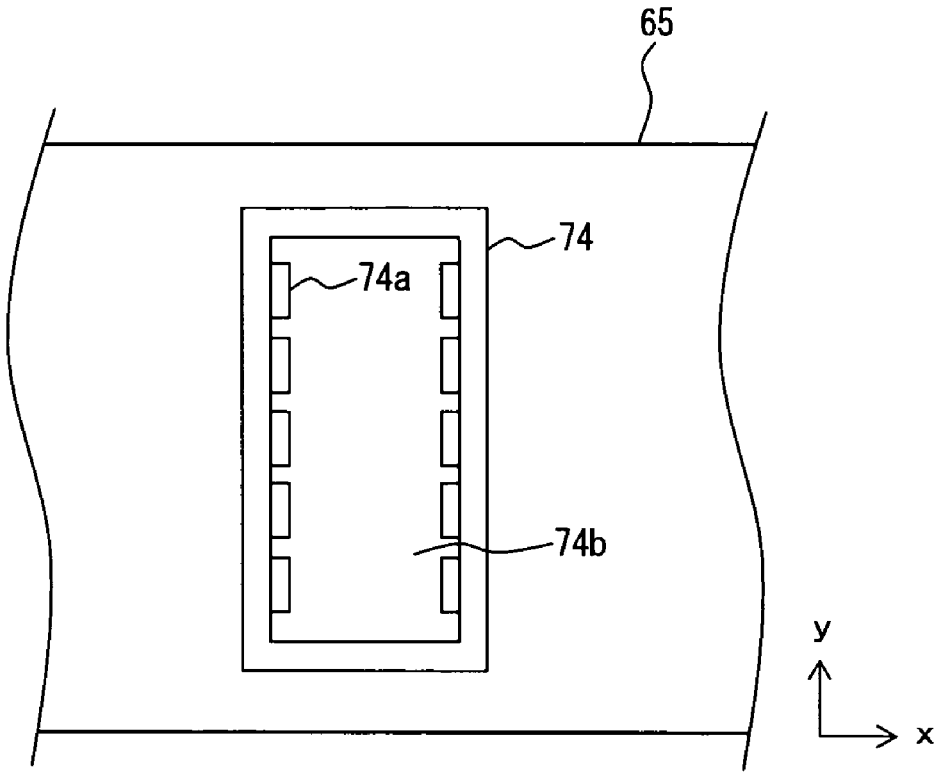

【Fig. 19】
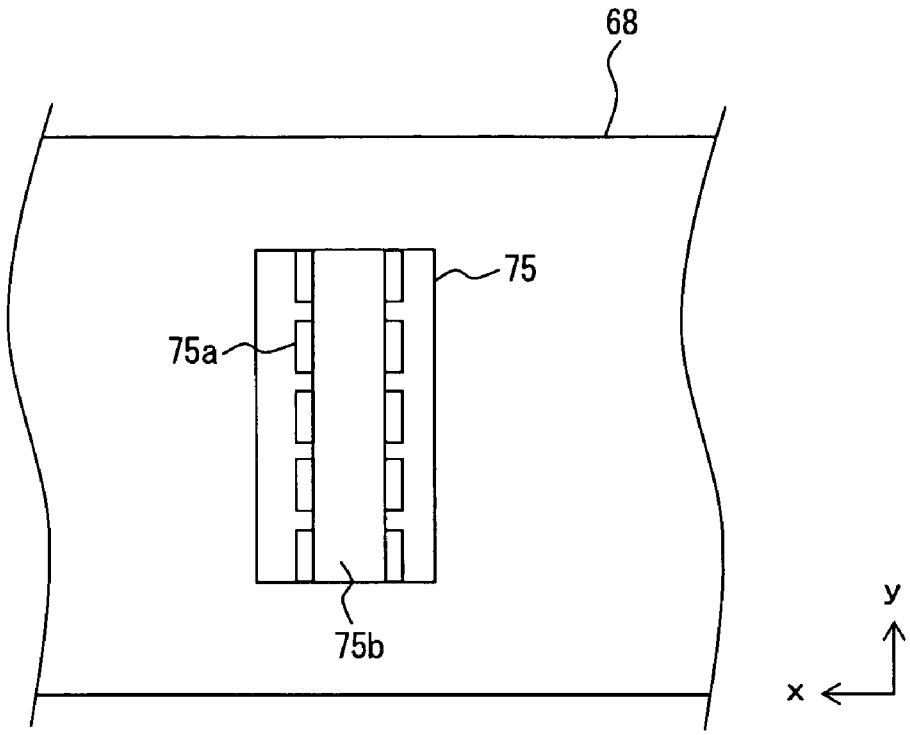

【Fig. 20】
(a)
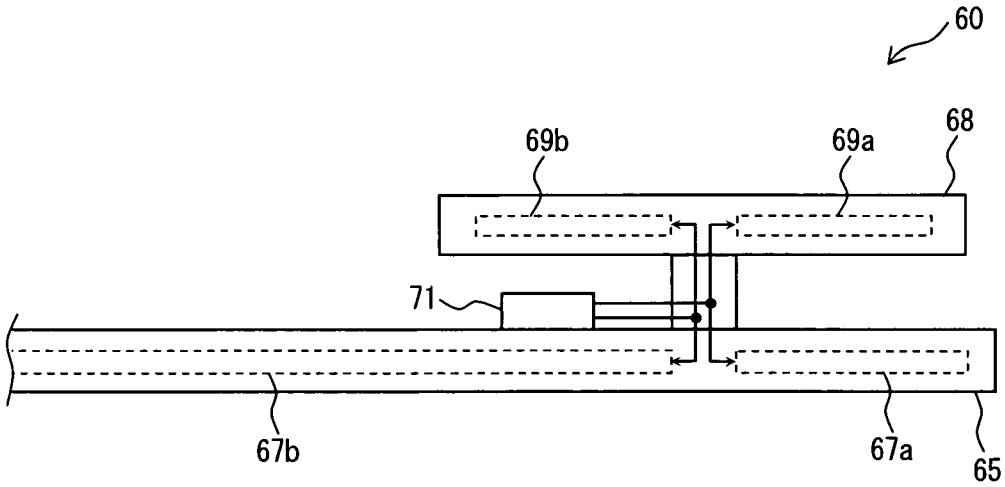
(b)
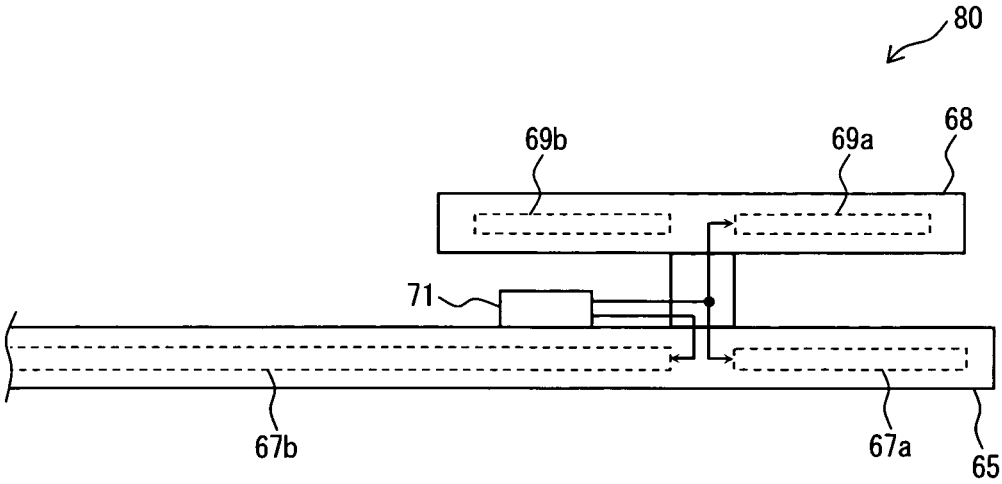

WIRELESS MICROPHONE DEVICE

TECHNICAL FIELD

The present invention relates to a wireless microphone device, and more particularly, to improvement of a wireless microphone device that makes a circuit board provided with an oscillation circuit for generating a high frequency signal function as an antenna element of a dipole antenna.

BACKGROUND ART

As a wireless microphone device for converting a voice signal from a microphone into a high frequency signal to wirelessly transmit it, handheld type device and two-piece type device are known. The handheld type wireless microphone device is a handheld wireless device in which microphone and transmitter units are integrated. The two-piece type microphone device is a wireless device in which a microphone unit and a transmitter unit are configured to respectively have separate housings, and connected to each other with a flexible transmission cable. The two-piece type microphone device is attachable to a waist belt, and therefore sometimes called a belt pack type device. Such two-piece type wireless microphone device has conventionally used a ¼λ whip antenna, a helical antenna, or a loop antenna as a transmitting antenna for the high frequency signal.

The ¼λ whip antenna is an antenna using as an antenna element a linear conductor having a length corresponding to a ¼λ of a transmitting radio wave, and used with being drawn out of the housing of the transmitter unit. The helical antenna is an antenna using a coil-like conductor as an antenna element, and characterized by a high Q factor (Quality factor) as compared with the ¼λ whip antenna. The loop antenna is an antenna using a loop-like conductor as an antenna element, and characterized by having an extremely high Q factor.

The wireless microphone device using the ¼λ whip antenna is used with the antenna being protruded from the housing of the transmitter unit, and therefore there arise problems that the transmission cable or a human body, and the antenna are likely to interfere with each other, and an antenna part is likely to be broken. Also, the antenna is used with being exposed, and therefore there arises a problem that radiation characteristics may be largely varied and sensitivity may be reduced due to a change in surrounding environment caused by the human body. On the other hand, in the wireless microphone device using the helical or the loop antenna, a frequency band for good radiation efficiency is narrow, and therefore there arises problems that a reduction in sensitivity upon variation of radiation characteristics due to change in surrounding environment is large, and that the antenna cannot be shared between wireless microphone devices respectively having different operating frequency bands.

In general, as the transmitting antenna for a high frequency signal, a ½λ dipole antenna is known in addition to the above described antennas. The ½λ dipole antenna is an antenna in which two linear antenna elements are arranged in their common longer direction, and end parts facing to each other are fed with a transmission signal. The ½λ dipole antenna is characterized by increasing a diameter of the antenna elements or using planate conductors as the antenna elements to thereby moderate the variation in radiation characteristics (e.g., variation in antenna impedance) due to a human body and widen a frequency band having good radiation efficiency.

The wireless microphone device using such a dipole antenna as a transmitting antenna is described in, for example, Patent document 1 or 2. The wireless microphone device described in Patent document 1 is a handheld type microphone device using a transmission cable for transmitting an electrical signal from a microphone to a circuit element on a circuit board and an electrical conductor in a housing as respective antenna elements of the dipole antenna.

The wireless microphone device described in Patent document 2 is a handheld type microphone device using circuit boards as antenna elements of the dipole antenna. The microphone device using the circuit boards as the antenna elements of the dipole antenna is advantageous in miniaturizing a housing and reducing manufacturing cost as compared with the case where the antenna elements are separately provided, and configured to have the planate antenna elements, and therefore the variation in radiation characteristics due to a human body can be moderated.

However, if a transmission circuit is provided on the circuit board used for the antenna element of the dipole antenna, a length of the circuit board, which effectively acts as the antenna element, is shortened, and therefore there arises a problem that desired radiation characteristics cannot be obtained.

FIGS. 9 (*a*) and (*b*) are diagrams illustrating an example of a configuration inside the conventional wireless microphone device, in which a dipole antenna 100 using two circuit boards 101 and 102 as the antenna elements respectively is illustrated. FIG. 9 (*a*) illustrates a front view of the dipole antenna 100 as viewed from a direction vertical to a face of the board, and FIG. 9 (*b*) illustrates a side view of the dipole antenna 100. In the dipole antenna 100, the circuit board 102 is provided thereon with an oscillator 103, and a high frequency signal generated by the oscillator 103 is fed to the respective circuit boards 101 and 102 through feeding points 105. The feeding points 105 are positioned on the other circuit board 101 side of the oscillator 103, and feeding paths 104 are provided from the oscillator 103 to the feeding points 105. On the feeding paths 104, an amplifier circuit for power-amplifying the high frequency signal, band-limiting filter for limiting a frequency band of the power-amplified high frequency signal, and the like are provided.

On the oscillator side 103 in the dipole antenna 100, a feeding direction of the high frequency signal is opposite between the feeding paths 104 and the circuit board 102, and therefore an overlap region A between the feeding paths 104 and the circuit board 102 does not effectively function as an antenna element due to electromagnetic coupling. For this reason, in a longer direction of the dipole antenna 100, a length of the circuit board 102, which effectively acts as the antenna element, is shortened, and therefore desired radiation characteristics cannot be obtained. In particular, if the circuit board 102 provided with the oscillator 103 is used as the antenna element of the dipole antenna, such phenomenon becomes significant, and therefore there arises a problem that in order to obtain the desired radiation characteristics, the circuit board 102 is increased in size, resulting in an increase in size of a housing of the microphone device.

Patent document 1: Japanese patent No. 3227142
Patent document 2: Japanese patent No. 3640744

DISCLOSURE OF THE INVENTION

Problem to be Solved by the Invention

As described above, in the conventional wireless microphone device, there exists a problem that in the case where the circuit board is used as the antenna element of the dipole antenna, the length of the circuit board, which effectively functions as the antenna element, is shortened, and therefore desired radiation characteristics cannot be obtained.

The present invention has been made in consideration of the above situations, and has an object to provide a wireless microphone device capable of suppressing a length of a circuit board, which effectively functions as an antenna element, from being shortened to thereby obtain desired radiation characteristics. In particular, the present invention has an object to provide a wireless microphone device that enables a circuit board, which is to be provided with an oscillation circuit, to be miniaturized without deteriorating the radiation characteristics.

Means Adapted to Solve Problems

A wireless microphone device according to a first aspect of the present invention is configured to include: a circuit board that is sectioned into a first circuit area and a second circuit area and makes the respective circuit areas function as antenna elements of a dipole antenna; an oscillation circuit that is arranged in the first circuit area and generates a high frequency signal on a basis of a voice signal from a sound collecting element; a feeding path for feeding the high frequency signal to an electrically conductive layer in the first circuit area through a feeding point positioned on the second circuit area side of the oscillation circuit; and a high frequency shield covering at least a part of the feeding path.

In the wireless microphone device, the circuit board is sectioned into the two circuit areas made to function as the antenna elements of the dipole antenna, and the high frequency signal is fed to the electrically conductive layer in the first circuit area through the feeding point positioned on the second circuit area side of the oscillation circuit. In this case, the high frequency shield covering at least the part of the feeding path for the high frequency signal is provided. Based on such a configuration, the part of the feeding path is shielded on the oscillation circuit side in the dipole antenna, and therefore a length of the circuit board, which effectively acts as the antenna element, can be suppressed from being shortened.

A wireless microphone device according to a second aspect of the present invention is, in addition to the above configuration, configured such that the high frequency shield is formed by covering the feeding path with a metal case having an opening at a bottom face and conducting the metal case to the electrically conducting layer in the first circuit area. Based on such a configuration, the high frequency shield is formed by covering with the metal case, and therefore even after the oscillation circuit and the feeding path have been provided on the circuit board, the high frequency shield can be formed.

A wireless microphone device according to a third aspect of the present invention is, in addition to the above configuration, configured such that the feeding path is provided with an amplifier circuit for amplifying the high frequency signal and a band-limiting filter for limiting a frequency band of the high frequency signal amplified by the amplifier circuit; and the metal case contains the oscillation circuit, the amplifier circuit, and the band-limiting filter. Based on such a configuration, the oscillation circuit, the amplifier circuit, and the band-limiting filter are contained in the metal case, and the part on the feeding path including these circuit elements is subjected to the high frequency shield, so that the part and the electrically conductive layer of the circuit board can be suppressed from being electromagnetically coupled.

A wireless microphone device according to a fourth aspect of the present invention is, in addition to the above configuration, configured such that the first circuit area and the second circuit area are electrically connected to each other, and a high frequency isolation element for passing a signal having a frequency lower than a frequency of the high frequency signal is provided. Based on such a configuration, the first and second circuit areas are electrically connected to each other through the high frequency isolation element, and between the circuit areas, the signal having a frequency lower than the frequency of the high frequency signal is passed, so that a circuit element for processing the lower frequency signal can be provided on the circuit board regardless of any of the circuit areas.

A wireless microphone device according to a fifth aspect of the present invention is configured to include: a first circuit board and a second circuit board that are arranged with end faces facing to each other and made to function as antenna elements of a dipole antenna; an oscillation circuit that is provided on a main face of the first circuit board and generates a high frequency signal on a basis of a voice signal from a sound collecting element; a feeding path for feeding the high frequency signal to an electrically conductive layer of the first circuit board through a feeding point positioned on the second circuit board side of the oscillation circuit; and a high frequency shield covering at least a part of the feeding path.

In the wireless microphone device, the two circuit boards arranged with end faces thereof facing to each other are made to function as the antenna elements of the dipole antenna, and the high frequency signal is fed to the electrically conductive layer of the first circuit board through the feeding point positioned on the second circuit board side of the oscillation circuit. In this case, the high frequency shield covering at least the part of the feeding path for the high frequency signal is provided. Based on such a configuration, the part of the feeding path is shielded on the oscillation circuit side in the dipole antenna, and therefore a length of the circuit board, which effectively acts as the antenna element, can be suppressed from being shortened.

Effect of the Invention

According to the wireless microphone device of the present invention, the part of the feeding path is shielded, so that the length of the circuit board, which effectively acts as the antenna element, can be suppressed from being shortened, and therefore desired radiation characteristics can be obtained without increasing the circuit board in size. Accordingly, the circuit board to be provided with the oscillation circuit can be decreased in size without deteriorating the radiation characteristics.

BEST MODE FOR CARRYING OUT THE INVENTION

First Embodiment

FIG. 1 is a perspective view illustrating an example of a schematic configuration of a wireless microphone device according to a first embodiment of the present invention, in which a two-piece type microphone device 1 is illustrated. The microphone device 1 includes a microphone unit 2, a transmission cable 3, and a transmitter unit 4, and respective housings of the microphone unit 2 and the transmitter unit 4 are connected to each other through the flexible transmission cable 3.

The microphone unit 2 is a sound collecting part having a microphone 2*a* in the housing. The microphone 2*a* is a sound collecting element for converting voice inputted from outside into an electrical signal to generate a voice signal. We here assume that a finely metal-meshed wind screen is arranged on one end face of the cylindrical housing, and the voice is inputted to the microphone 2*a* through the wind screen. Also, we assume that the transmission cable 3 is connected to the other end face. The voice signal generated by the microphone 2*a* is transmitted to the transmitter unit 4 through the transmission cable 3.

The transmission cable 3 is a flexible conductive cable for feeding power from the transmitter unit 4 to the microphone unit 2 and transmitting the voice signal from the microphone unit 2 to the transmitter unit 4. As such a transmission cable 3, for example, there is used a coaxial cable in which an insulation layer and an electrically conductive layer are sequentially formed on an outer circumference of a core cable.

The transmitter unit 4 is a main body part having, in the small portable housing, a circuit board 5 that is made to function as an antenna element. The housing of the transmitter unit 4 is of a vertically long rectangular parallelepiped shape, and connected with one end of the transmission cable 3 at an upper face thereof. In the transmitter unit 4, an operation for converting the voice signal inputted from the microphone unit 2 through the transmission cable 3 into a high frequency signal to transmit it is performed.

The circuit board 5 is a board provided with an oscillation circuit for generating a high frequency signal for transmission, a power supply circuit, and the like, and as the circuit board 5, for example, a printed board formed with a wiring pattern is used. The circuit board 5 is sectioned into two circuit areas, which respectively function as antenna elements of a dipole antenna by being fed with the high frequency signal from the oscillation circuit. The circuit board 5 is arranged with a longer direction thereof corresponding to a longer direction of the housing of the transmitter unit 4.

In the housing of the transmitter unit 4, a battery 6 for feeding a DC power to the oscillation circuit and the microphone 2*a* is contained, in addition to the circuit board 5. The battery 6 is of a vertically long columnar shape, and arranged with electrode terminals on end faces thereof. We here assume that the circuit board 5 is formed in an L-shape to laterally arrange the battery 6. The battery 6 is arranged in a cutout part of the circuit board 5, which is cut out in a shorter direction, with a longer direction thereof corresponding to the longer direction of the circuit board 5.

The microphone unit 2 is typically provided with a wearing member such as a clip, and upon collection of user's voice, the microphone unit 2 is used with being attached to the vicinity of a chest of the user with the wearing member. On the other hand, the transmitter unit 4 is used with being put in a bag or a pocket, or attached to a waist belt of the user.

<High Frequency Shield for Feeding Path>

FIG. 2 is a plan view illustrating a configuration example in a main part of the microphone device 1 in FIG. 1, in which the circuit board 5 sectioned into the two circuit areas 11*a* and 11*b* that are made to function as the antenna elements of the dipole antenna is illustrated. The circuit board 5 is a multi-layered board in which an electrically conductive layer and a wiring layer are formed with sandwiching an insulation layer, and each of the electrically conductive layer and wiring layer is sectioned into the two circuit areas 11*a* and 11*b*.

The electrically conductive layer is a layer formed of an electrical conductor, and used as a ground layer (GND layer) for grounding circuit elements provided on the circuit board 5, or a power supply layer for feeding power to the circuit elements. The wiring layer is a layer including a wiring pattern making electrical connections among the circuit elements, and formed on a surface of the board.

The two circuit areas 11*a* and 11*b* are areas on a board face (main face), which are isolated from each other in terms of high frequency while being electrically conducted to each other. That is, each of the circuit areas 11*a* and 11*b* includes the electrically conductive layer, the wiring layer, and the circuit elements that are not isolated from one another in terms of high frequency. Between these areas, processing for passing a signal having a frequency lower than a predetermined frequency and blocking a signal having a frequency higher than the predetermined frequency is performed. Specifically, the processing for passing a signal having a frequency lower than a frequency of the high frequency signal for transmission, for example, a signal transmitted between the circuit elements, or the DC power, and blocking a high frequency signal including the high frequency signal for transmission is performed.

We here assume that a plurality of high frequency choke circuits 16 are provided on the circuit board 5, and the circuit areas 11*a* and 11*b* are electrically connected to each other through the high frequency choke circuits 16. The high frequency choke circuit 16 makes the electrical connection between the two circuit areas 11*a* and 11*b*, and is a high frequency isolation element for passing the signal having a frequency lower than that of the high frequency signal for transmission, and blocking the high frequency signal including the high frequency signal for transmission. As such a high frequency isolation element, an RFC (Radio Frequency Choke coil), or a resistor having a large resistance value can be used.

In the present embodiment, the board face is vertically sectioned in the middle of the circuit board 5, and the upper area is the circuit area 11*a* whereas the lower area is the circuit area 11*b*. That is, the circuit area 11*a* is formed over the entire board face of an L-shaped bent part of the circuit board 5, and thus formed of an L-shape. Also, the circuit area 11*b* is of a rectangular shape. Each of the high frequency choke circuits 16 is arranged between these circuit areas 11*a* and 11*b*, and makes a connection between the electrically conductive layers or wiring layers in the respective areas. Note that the longer direction of the circuit board 5 is referred to as a y-axis direction, and a direction vertical to the y-axis direction (horizontal direction) is referred to as an x-axis direction.

On such the circuit board 5, a metal case 12, connection circuits 13, 14*a*, and 14*b*, an oscillation circuit 21, an amplifier circuit 22, and a band-limiting filter circuit 23 are provided, in addition to the high frequency choke circuits 16. The oscillation circuit 21 is a circuit for generating the high frequency signal on the basis of the voice signal from the microphone 2*a*, and arranged in the circuit area 11*b*. As the oscillation circuit 21, for example, a VCO (Voltage Controlled Oscillator) that oscillates according to a variation in a voltage level of the voice signal is used.

The amplifier circuit 22 is a circuit for power-amplifying the high frequency signal generated by the oscillation circuit 21, and provided on feeding paths for feeding the high frequency signal from the oscillation circuit 21 to the electrically conductive layers in the respective circuit areas 11*a* and 11*b*. The feeding paths are formed of feeding lines 24 for feeding the high frequency signal generated by the oscillation circuit 21 to the electrically conductive layers in the respective circuit areas 11*a* and 11*b* through feeding points positioned on the circuit area 11*a* side of the oscillation circuit 21.

The band-limiting filter circuit 23 is a circuit for limiting a frequency band of the power-amplified high frequency signal, and provided on the above-described feeding paths. We here assume that a low pass filter for removing a signal component having a frequency higher than the predetermined frequency is used as the band-limiting filter circuit 23. By the band-limiting filter circuit 23, a harmonic wave generated upon power amplification or the like, i.e., noise having a frequency higher than that of the high frequency signal generated in the oscillation circuit 21 can be removed.

The oscillation circuit 21, the amplifier circuit 22, and the band-limiting filter circuit 23 are provided on the same board face, and arranged along the feeding paths in the order of the amplifier circuit 22, and the band-limiting filter circuit 23. That is, the high frequency signal generated by the oscillation circuit 21 is amplified by the amplifier circuit 22, and then a passband thereof is limited by the band-limiting filter circuit 23.

We here assume that the feeding lines 24 are formed as a part of the wiring pattern on the circuit board 5. We also assume that the feeding lines 24 on the surface of the circuit board 5, and the electrically conductive layers 11 are electrically conducted to each other through through-holes 25. The through-hole 25 is a conduction hole provided on the circuit board 5 to make an electrical connection between the conduction layer and the wiring layer, and used as a feeding point.

We here assume that the feeding line 24 on a higher potential side is connected to the electrically conductive layer in the circuit area 11*a*, and that the feeding line 24 on a lower potential side is connected to the electrically conductive layer in the circuit area 11*b*. The feeding points for the high frequency signals having different potentials are formed in area end parts through which the circuit areas 11*a* and 11*b* face to each other. The high frequency signals having different potentials are respectively fed, and therefore the electrically conductive layer in the circuit area 11*a* functions as a hot side antenna element of the dipole antenna, and that in the circuit area 11*b* functions as a cold side antenna element. That is, regarding the two circuit areas 11*a* and 11*b*, the high frequency signal for transmission is fed from the one circuit area 11*b* to the other circuit area 11*a* through the feeding lines 24, and therefore the high frequency signals transmitted through the feeding lines 24 are not isolated from each other in terms of high frequency.

The connection circuit 13 makes an electrical connection between the transmission cable 3 and the circuit board 5, and is a circuit including a high frequency isolation element for passing the signal having a frequency lower than the predetermined frequency, and blocking the signal having a frequency higher than the predetermined frequency. Specifically, the processing for passing the signal having a frequency lower than that of the high frequency signal for transmission, for example, a signal transmitted between the circuit elements, or the DC power, and blocking the signal having a frequency higher than that of the high frequency signal is performed. The connection circuit 13 is provided in the circuit area 11*a*, and passes the DC power fed to the microphone 2*a* and the voice signal from the microphone 2*a*, as well as blocking the high frequency signal from flowing from the circuit board 5 into the transmission cable 3. We here assume that the connection circuit 13 is arranged with being adjacent to an upper end face of the circuit board 5.

The connection circuit 13 blocks the high frequency signal from flowing into the transmission cable 3, and can therefore prevent the transmission cable 3 from interfering with the dipole antenna in terms of high frequency. We here assume that the connection circuit 13 includes a connector for making a connection to the transmission cable 3.

The connection circuits 14*a* and 14*b* make an electrical connection between the battery 6 and the circuit board 5, and are high frequency isolation elements for passing the signal having a frequency lower than the predetermined frequency and blocking the signal having a frequency higher than the predetermined frequency. Specifically, processing for passing the signal having a frequency lower than that of the high frequency signal for transmission, i.e., the DC power from the battery 6, and blocking the signal having a frequency higher than that of the high frequency signal is performed.

The connection circuit 14*a* is provided in the circuit area 11*a*, and passes the DC power from the battery 6 as well as blocking the high frequency signal for transmission from flowing from the circuit board 5 into the battery 6. Also, the connection circuit 14*b* is provided in the circuit area 11*b*, and passes the DC power from the battery 6 as well as blocking the high frequency signal for transmission from flowing from the circuit board 5 into the battery 6. We here assume that the connection circuit 14*a* is connected to a terminal electrode 15*a* for coming into contact with a positive electrode of the battery 6, and the connection circuit 14*b* is connected to a terminal electrode 15*b* for coming into contact with a negative electrode of the battery 6.

We here assume that a battery containing part 17 for containing the battery 6 is provided on the right hand side of the circuit board 5, and in the battery containing part 17, the battery 6, and terminal electrodes 15*a* and 15*b* are arranged.

The battery 6 includes a cylindrical main body, and the two electrode terminals, i.e., positive and negative electrodes, respectively arranged on end faces of the main body. In this example, with respect to an arrangement direction (y-axis direction) of the circuit areas 11*a* and 11*b*, the battery 6 is arranged with being longer than each of the circuit areas 11*a* and 11*b* and the longer direction thereof corresponding to the y-axis direction. That is, the battery 6 is arranged with, in the y-axis direction, a part of the main body being adjacent to one of the circuit areas, and the other part being adjacent to the other circuit area. Accordingly, the main body of the battery 6 is arranged along the two circuit areas 11*a* and 11*b*. We here assume that the battery 6 is arranged with an end part on the positive electrode side facing to an end face of the circuit board 5 on the circuit area 11*a* side, and an end part on the negative electrode side facing to an end face of the circuit board 5*a* on the circuit area 11*b* side.

The terminal electrodes 15*a* and 15*b* are connecting terminals provided in the battery containing part 17, and adapted to form a battery holder for holding the battery 6. Regarding the terminal electrode 15*a*, one end thereof is attached to an end part of the circuit board 5 protruding in the x-axis direction, and the other end extends to a lower side from the one end part, i.e., outward from the circuit board 5. Regarding the terminal electrode 15*b*, one end thereof is attached to a lower end part of the circuit board 5, and the other end extends to a right hand side from the one end part, i.e., outward from the circuit board 5. The battery 6 is attached between such terminal electrodes 15*a* and 15*b*.

The DC power is fed to the circuit elements within the circuit areas from the battery 6 through the terminal electrodes 15*a* and 15*b* and the connection circuit 14*a* and 14*b*. On the other hand, the high frequency signal is prevented from flowing from the oscillation circuit 21 to the battery 6 by the respective connection circuits 14*a* and 14*b*.

The metal case 12 is a part of a high frequency shield covering at least a part of the feeding paths formed on such circuit board 5, and a box body that has an opening at a bottom face and is made of electrically conductive metal. The metal case 12 is arranged on the circuit board 5 with covering the feeding paths. By electrically conducting the metal case 12 to the electrically conductive layer in the circuit area 11*b*, the high frequency shield is formed.

Such the high frequency shield is not particularly limited in terms of shape or material thereof as long as it can suppress a radio wave radiated from the part of the feeding paths from leaking outside. We here assume that the oscillation circuit 21, the amplifier circuit 22, and the band-limiting filter circuit 23 are contained in the metal case 12.

We here assume that the high frequency signal generated by the oscillation circuit 21 has a frequency of approximately 500 to 1000 MHz, and a y-axial length of each of the circuit areas 11*a* and 11*b* as the antenna element is a ¼ wavelength, i.e., 15 to 7.5 cm or less. Also, a y-axial length of the feeding path is approximately ⅔ of that of the circuit area 11*b*.

FIG. 3 is a cross-sectional view illustrating a configuration example in the circuit board 5 of FIG. 2, in which a cross-sectional appearance cut along an A1-A1 line on the feeding path is illustrated. The metal case 12 is arranged with covering a part of an overlap area A2 between the feeding path and the electrically conductive layer 11, i.e., a part A3 of the feeding path from the oscillation circuit 21 to the through-hole 25 (feeding point). The feeding line 24 extending from the band-limiting filter circuit 23 is led out from the opening 12*a* provided through the metal case 12.

By arranging the metal case 12 covering the part A3 of the feeding path, the metal case 12, and the electrically conductive layer 11, particularly a surface of the electrically conductive layer 11 on the oscillation circuit 21 side form the high frequency shield, and therefore the high frequency signal flowing through the feeding path and the high frequency signal flowing through the electrically conductive layer 11 can be suppressed from interfering with each other. Accordingly, the part A3 of the overlap area A2 can be made to effectively function as the antenna element, and therefore the circuit board 5 acting as the antenna elements, particularly the y-axial length of the electrically conductive layer 11 can be prevented from being shortened by a length of the part A3.

FIG. 4 is a diagram illustrating a configuration example in the circuit board 5 of FIG. 2, in which an appearance of the metal case 12 that is arranged on the circuit board 5 and viewed from the y-axis direction is illustrated. A side face of the metal case 12 is provided with the rectangular-shaped opening 12*a* for leading out the feeding lines 24.

Each of the hot and cold side feeding lines 24 is wired between the band-limiting filter circuit 23 and the through-hole 25 through the opening 12*a*.

FIG. 5 is a plan view illustrating the configuration example in the circuit board 5 of FIG. 2, in which soldered parts 26*a* and 26*b* of the metal case 12, which are soldered to the electrically conductive layer 11, are illustrated. An abutting part with the circuit board 5 in the metal case 12 is soldered at a plurality of points to make the electrical connection between the metal case 12 and the electrically conductive layer 11. We here assume that as such soldered parts 26*a* and 26*b*, the two parts (soldering parts 26*a*) in an end part of the metal case 12 on the opening 12 side, and the other two parts (soldering parts 26*b*) on a side opposite to the opening 12*a* are provided. That is, the metal case 12 is soldered at the four corners thereof.

Regarding the soldered parts, it is considered that the metal case 12 itself can be made to more effectively function as the antenna element by the soldered parts are positioned closer to the high frequency signal feeding points for the electrically conductive layer 11, and therefore at least the end part on the opening 12*a* side, i.e., the end part on the feeding point side is preferably soldered.

FIGS. 6 (*a*) and (*b*) are diagrams illustrating an example of operations of the microphone device 1 in FIG. 1, which is compared with a conventional example, and FIG. 6 (*a*) illustrates radiation characteristics B1 according to the present embodiment, whereas FIG. 6 (*b*) illustrates radiation characteristics B2 according to the conventional example. The microphone device 1 has the radiation characteristics B1 in which a frequency band for good radiation efficiency is wide, because the circuit board 5 is made to function as the antenna elements of the dipole antenna. We here assume that a frequency at which the radiation efficiency is maximized is denoted by $f_0$, and the maximum value of the radiation efficiency is denoted by $a_0$.

The radiation characteristics B1 exhibit gradual variation in radiation efficiency, and therefore even if the radiation characteristics are varied by variation in surrounding environment due to a human body, a variation in radiation efficiency is generally small. Specifically, the variation in radiation efficiency upon variation of a resonant frequency from $f_0$ to $f_1$ is $(a_0-a_1)$.

On the other hand, the conventional wireless microphone device using an antenna protruded from a housing of a transmitter unit, like a ¼λ whip antenna, or using an antenna like a helical antenna has the radiation characteristics B2 in which a frequency band for good radiation efficiency is narrow. For this reason, if the radiation characteristics are varied due to a human body, the radiation efficiency will be largely varied. Specifically, a variation in radiation efficiency upon variation of a resonant frequency from $f_0$ to $f_1$ is $(a_0-a_2)(>(a_0-a_1))$.

As described, in the microphone device 1 using the circuit board 5 as the antenna elements of the dipole antenna, the variation in radiation characteristics due to a human body is gradual as compared with the conventional microphone device, and therefore the reduction in radiation efficiency can be suppressed.

According to the present embodiment, the part of the feeding paths is shielded on the oscillation circuit 21 side in the dipole antenna, and therefore the length of the circuit board 5, which effectively acts as the antenna elements, can be suppressed from being shortened. In particular, the y-axial length of the part of the electrically conductive layer in the circuit area 11*b*, which effectively acts as the antenna element, can be prevented from being shortened. Accordingly, the desired radiation characteristics can be obtained without increasing in size the circuit board 5 provided with the oscillation circuit 21, and also the housing of the transmitter unit 4 can be decreased in size.

Also, the high frequency shield is formed by use of the metal case 12, and therefore even after the oscillation circuit 21 and the feeding paths have been provided on the circuit board 5, the high frequency shield can be formed. The oscillation circuit 21, the amplifier circuit 22, and the band-limiting filter circuit 23 are contained in the metal case 12, and the part on the feeding paths including these circuit elements is subjected to the high frequency shield, so that the part and the electrically conductive layer 11 of the circuit board 5 can be suppressed from being electromagnetically coupled. Further, the circuit areas 11*a* and 11*b* are electrically connected to each other through the high frequency choke circuits 16, and the signal having a frequency lower than that of the high frequency signal is passed between the circuit areas, so that a circuit element for processing the lower frequency signal can be provided on the circuit board 5 regardless of any of the circuit areas.

Also, the electrically conductive layer 11 made to function as the antenna element of the dipole antenna is used as a part of the high frequency shield, so that it is not necessary to newly provide such electrically conductive layer within the circuit board 5, and therefore manufacturing cost can be suppressed.

Note that, in the present embodiment, there is described as an example the case where the one circuit board 5 is sectioned into the two circuit areas 11*a* and 11*b*, and the respective circuit areas are made to function as the antenna elements of the dipole antenna; however, the present invention is not limited to this. For example, the present invention may be applied to a configuration in which two circuit boards are respectively used as the antenna elements of the dipole antenna.

FIG. 7 is a plan view illustrating another configuration example in the main part of the microphone device 1 in FIG. 1, in which two circuit boards 111 and made to function as the antenna elements of the dipole antenna are illustrated. The circuit board 112 is a first circuit board provided with the oscillation circuit 21, the amplifier circuit 22, the band-limiting filter circuit 23, and the connection circuit 14*b*. The circuit board 111 is a second circuit board arranged with an end face thereof facing to an end face of the circuit board 112, and provided with the connection circuit 14*a*.

The two circuit boards 111 and 112 are electrically connected to each other through the high frequency choke circuits 16. The high frequency signal is fed to the electrically conductive layers of the respective circuit boards 111 and 112 through the feeding points positioned on the circuit board 111 side of the oscillation circuit 21. Even in such a configuration, the part of the feeding paths is shielded on the oscillation circuit 21 side in the dipole antenna, and therefore a length of the circuit board 112 effectively acting as the antenna element can be suppressed from being shortened.

Also, in the present embodiment, there is described the case where the positive and negative electrodes of the battery 6 are respectively connected to the different circuit areas through the terminal electrodes 15*a* and 15*b*; however, the present invention is not limited to this. For example, in the case where a battery has positive and negative electrodes on one end face of a main body thereof, the present invention can be applied to a configuration in which the positive and negative electrodes of the battery are both connected to one of the circuit areas.

FIG. 8 is a plan view illustrating still another configuration example in the microphone device 1 of FIG. 1, in which the circuit board 5 of which terminal electrodes 121*a* and 121*b* are both arranged on the circuit area 11*a* side is illustrated. In this example, a battery 130 includes: a main body of a vertically long rectangular parallelepiped shape, and two electrode terminals, i.e., positive and negative electrodes, arranged on one end face of the main body. A battery containing part 123 includes the battery 130 with, in the arrangement direction of the respective circuit areas 11*a* and 11*b*, a part of the main body of the battery 130 being adjacent to one of the circuit areas and the other part being adjacent to the other circuit area.

The terminal electrodes 121*a* and 121*b* are connecting terminals to be connected to the battery 130, and both are arranged on the circuit area 11*a* side in the battery containing part 123. The terminal electrode 121*a* is brought into contact with a positive electrode of the battery 130 to connect the positive electrode to a connection circuit 122*a*. The terminal electrode 121*b* is brought into contact with a negative electrode of the battery 130 to connect the negative electrode to a connection circuit 122*b*. The connection circuits 122*a* and 122*b* make an electrical connection between the battery 130 and the circuit area 11*a*, and are high frequency isolation elements for passing the signal having a frequency lower than the predetermined frequency and blocking the signal having a frequency higher than the predetermined frequency.

Even in such a case, the high frequency signal can be prevented from flowing from the circuit area 11*a* to the battery 130 through the terminal electrodes 121*a* and 121*b* of the battery containing part 123, and therefore the battery 130 and the circuit board 5 can be suppressed from being coupled in terms of high frequency.

<High Frequency Isolation of Battery>

FIG. 10 is a cross-sectional view illustrating the configuration example of the microphone device 1 in FIG. 2, in which a cross-sectional appearance that is cut along an A4-A4 line and vertical to the x-axis direction is illustrated. The terminal electrode 15*a* of which one end 32 is attached to a wiring pattern 33 on the circuit board 5 and the other end 31 is an electrode to be brought into contact with the positive electrode of the battery 6 is formed by bending a thin metal plate. The one end 32 of the terminal electrode 15*a* is arranged on the face of the circuit board 5 with at least a part of the one end 32 being in abutting contact with the board face.

The other end 31 of the terminal electrode 15*a* is formed almost vertically to the face of the circuit board 5, and an electrode face thereof faces to the end face of the circuit board 5.

Current flowing out of the positive electrode of the battery 6 flows from the other end 31 to the one end 32 of the terminal electrode 15*a*, and reaches the connection circuit 14*a* through the wiring pattern 33.

FIG. 11 is a cross-sectional view illustrating the configuration example of the microphone device 1 in FIG. 2, in which a cross-sectional appearance that is cut along an A5-A5 line and vertical to the y-axis direction is illustrated. The terminal electrode 15*b* is attached to the wiring pattern 33 on the circuit board 5 at one end 35 thereof, and brought into contact with the negative electrode of the battery 6 at the other end 34 thereof. The one end 35 of the terminal electrode 15*b* is arranged on the face of the circuit board 5 with at least a part of the one end 35 being in abutting contact with the board face. The other end 34 of the terminal electrode 15*b* is formed almost vertically to the face of the circuit board 5, and an end face of an electrode thereof faces to the end face of the circuit board 5.

Current flowing out of the negative electrode of the battery 6 flows from the other end 34 to the one end 35 of the terminal electrode 15*b*, and reaches the connection circuit 14*b* through the wiring pattern 33.

According to the present embodiment, connections between the connecting terminals and the circuit areas are isolated in terms of high frequency by the connection circuits 14*a* and 14*b*, and therefore the high frequency signal can be prevented from flowing from the circuit areas to the battery 6 through the connecting terminals of the battery containing part 17. Accordingly, in the case where the battery main body is arranged along the respective circuit areas 11*a* and 11*b* in the arrangement direction, high frequency coupling between the battery 6 and the circuit board 5 can be suppressed, and therefore the respective circuit areas 11*a* and 11*b* of the circuit board 5 can be made to function as the antenna elements of the dipole antenna.

In the microphone device 1 illustrated in FIGS. 10 and 11, distances between the surface of the circuit board 5 and the electrically conductive layers 11 are small in arrangement areas A6 in which the one ends of the terminal electrodes 15*a* and 15*b* are arranged, and therefore the above-described one ends or parts of the wiring pattern 33 may be coupled with the electrically conductive layers 11 in terms of high frequency. The arrangement areas A6 are areas on the face of the circuit board 5, which include the one ends, and the parts of the wiring pattern 33 from the one ends to the connection circuits 14*a* and 14*b*.

Second Embodiment

In the first embodiment, there is described as an example the case where the connections between the terminal electrodes and the circuit areas are isolated in terms of high frequency by the high frequency isolation elements. In such a case, there exists the problem that the one ends or the parts of the wiring pattern 33 are coupled with the electrically conductive layers 11 in terms of high frequency in the arrangement areas A6 in which the one ends of the terminal electrodes 15*a* and 15*b* are arranged. In the present embodiment, by improving the configuration around the terminal electrodes 16*a* and 15*b*, the high frequency coupling between the one ends or parts of the wiring pattern 33 and the electrically conductive layers 11 in the above-described arrangement areas for the one ends is prevented.

FIG. 12 is a cross-sectional view illustrating a configuration example of a wireless microphone device 40 according to a second embodiment of the present invention. The wireless microphone device 40 according to the present embodiment is, as compared with the microphone device 1 in FIG. 10, different in that the electrically conductive layer 11 is not formed in an arrangement area A7 in which one end 32 of the terminal electrode 15*a* is arranged.

A connection circuit 14*a* includes a columnar circuit element of which both ends are provided with connecting terminals, and the one end is connected to a wiring pattern in the circuit area 11*a* whereas the other end is connected with the one end 32 of the terminal electrode 15*a* through the wiring pattern 33.

The arrangement area A7 is an area on a face of a circuit board 5, in which the one end of the terminal electrode 16*a* is arranged, and, in this case, the one end 32, the wiring pattern 33 from the one end 32 to the connection circuit 14*a*, and the connection circuit 14*a* are included. That is, the arrangement area A7 is the area including: the one end 32 of the terminal electrode 15*a*; and the conduction path between the one end 32 and the connecting terminal at the other end of the connection circuit 14*a*. In this example, a configuration around the terminal electrode 15*a* on a positive electrode side of a battery 6 is illustrated; however, a configuration around a terminal electrode 15*b* on a negative electrode side is also the same as that on the positive electrode side.

FIG. 13 is a plan view illustrating the configuration example of the wireless microphone device 40 in FIG. 12, in which an appearance of the circuit areas 11*a* and 11*b* that are formed with the arrangement areas A7 being excluded is illustrated. Each of the circuit areas 11*a* and 11*b* is formed with the arrangement area A7 for the one end 32 of each of the terminal electrodes 15*a* and 15*b* being excluded. That is, in the circuit area 11*a*, excluded is an area including the one end 32, the conduction path between the one end 32 of the terminal electrode 15*a* and the connecting terminal at the other end of the connection circuit 14*a*, and the connection circuit 14*a*. Also, in the circuit area 11*b*, excluded is an area including the one end 32, a conduction path between the terminal electrode 15*b* and the connection circuit 14*b*, and the connection circuit 14*b*. That is, the electrically conductive layer in each of the circuit areas 11*a* and 11*b* is formed not to overlap with the arrangement area A7.

According to the present embodiment, the electrically conductive layer 11 is not formed in the arrangement area A7 in which the one end 32 of the terminal electrode is arranged, so that the end part of each of the terminal electrodes 15*a* and 15*b*, and the conduction path between the one end 32 of the terminal electrode and the connecting terminal at the other end of each of the connection circuit 14*a* and 14*b* can be prevented from being coupled with the electrically conductive layer 11 in terms of high frequency, and therefore high frequency coupling between the battery 6 and the circuit board 5 can be effectively suppressed.

Note that, in the present embodiment, there is described as an example the case where the high frequency coupling between the one end 32 and the electrically conductive layer 11 is prevented by forming each of the circuit areas 11*a* and 11*b* with excluding the arrangement area A7 in which the one end 32 of each of the terminal electrodes 15*a* and 15*b* is arranged; however, the present invention is not limited to this. For example, the connection circuits 14*a* and 14*b* may be arranged with facing in a direction intersecting the face of the circuit board 5, such that one ends thereof are attached to the board face whereas the other ends are attached with one ends of the terminal electrodes 15*a* and 15*b*.

FIG. 14 is a cross-sectional view illustrating another configuration example in the microphone device according to the second embodiment of the present invention. In the microphone device 50, each connection circuit 52 is arranged with facing in a direction intersecting the face of the circuit board 5, in this example, facing in a direction vertical to the board face. A terminal electrode 51 is an electrode of which one end is arranged in the circuit area, and the other end is brought into contact with the positive or negative electrode of the battery 6. The connection circuit 52 is a high frequency isolation element in which a connecting terminal 52*a* arranged at one end of the connection circuit 52 is attached to the wiring pattern 33, and a connecting terminal 52*b* at the other end is attached with one end of the terminal electrode 51.

Regarding the terminal electrode 51, the one end A8 is attached to the other end of the connection circuit 52 with being made parallel to the board face, and the other end part is brought into contact with the positive or negative electrode of the battery 6. By configuring as described above, the columnar circuit element 52 that is arranged with facing in the direction intersecting the board face can be attached with the one end of the terminal electrode 51 at the connecting terminal 52*b* thereof on the side opposite to the board face, and therefore the terminal electrode 51 can be arranged with the one end A8 of the terminal electrode 51 being away from the board face. Accordingly, the one end A8 of the terminal electrode 51 can be prevented from being coupled with the electrically conductive layer 11 of the circuit board 5, and therefore the high frequency coupling between the battery 6 and the circuit board 5 can be more effectively prevented.

Embodiment 3

In the present embodiment, there is described a case where in order to suppress currents from being electromagnetically cancelled each other between circuit boards, which may occur when the circuit boards have the multistep structure, the respective circuit boards are electrically connected to each other in a location where two circuit areas face to each other.

FIG. 15 is an appearance diagram illustrating a schematic configuration of a wireless microphone device according to a third embodiment of the present invention, in which a handheld type microphone device 60 is illustrated. The microphone device 60 includes a wind screen 61 for containing a microphone 63, and a transmitter main body 62. The wind screen 61 is a wind shield formed of a finely metal-meshed net or the like, and prevents the microphone 63 from picking up noise due to wind.

The transmitter main body 62 is formed of a vertically long tubular housing, and inside the housing, a circuit board 65 provided with an oscillation circuit, and a battery 66 for feeding the DC power to the oscillation circuit and the microphone 63 are contained. A voice signal from the microphone 63 is transmitted to the oscillation circuit on the circuit board 65 through a transmission cable 64. When the microphone device 60 is used, the transmitter body 62 is held by hand.

FIG. 16 is a diagram illustrating a configuration example in a main part of the microphone device 60 in FIG. 15, in which two circuit boards 65 and 68 made to function as the antenna elements of the dipole antenna are illustrated. The circuit board 65 is a first circuit board that is arranged with a longer direction thereof corresponding to a longer direction of the transmitter main body 62. We here refer to the longer direction of the circuit board 65 as an x-axis direction, and a direction vertical to the x-axis direction, i.e., a direction vertical to a board face as a z-axis direction.

The circuit board 65 is a multilayered board in which an electrically conductive layer and a wiring layer are formed with sandwiching an insulation layer, and each of the electrically conductive and the wiring layers is sectioned into two circuit areas. In the respective circuit areas, electrically conductive layers 67*a* and 67*b* are formed. The respective circuit areas are arranged with an arrangement direction thereof corresponding to the x-axis direction. The respective electrically conductive layers 67*a* and 67*b* are isolated in terms of high frequency while being electrically conducted to each other.

We here assume that the electrically conductive layers 67*a* and 67*b* are ground layers for grounding circuit elements provided on the circuit board 65, or power supply layers for feeding power to the circuit elements on the circuit board 65.

In this example, on the left hand side, i.e., the circuit area on the microphone side 63 is longer in the x-axis direction than that on the right hand side, and in the circuit area on the left hand side, the battery 66, an oscillation circuit 71, terminal electrodes 72*a* and 72*b*, and a connector 73 are provided. Each of the terminal electrodes 72*a* and 72*b* is connected to a wiring pattern within the circuit area at one end thereof, and brought into contact with a positive or negative electrode of the battery 66 at the other end. The battery 66 is arranged on the board face facing to the circuit board 68 with a longer direction thereof corresponding to the x-axis direction. The connector 73 is a connecting means adapted to removably connect the transmission cable 64 from the microphone 63. The connector 73 is arranged in an end part of the circuit board 65 on the microphone 63 side, and the oscillation circuit 71 is arranged on a side opposite to the microphone 63. The battery 66, and the respective terminal electrodes 72*a* and 72*b* are arranged on the oscillation circuit 71 side of the connector 73.

The circuit board 68 is a second circuit board that is arranged with a board face thereof facing to the face of the circuit board 65, and sectioned into two circuit areas. In the respective circuit areas, electrically conductive layers 69*a* and 69*b* are formed. The respective electrically conductive layers 69*a* and 69*b* are isolated in terms of high frequency while being electrically conducted to each other. The circuit board 68 is short in an x-axial length as compared with the circuit board 65.

The circuit boards 65 and 68 are electrically connected to each other by connectors 74 and 75 in a facing area C1 including an area between the two circuit areas. The facing area C1 is an area that is on the face of the circuit board 65, and includes an area between end faces of the respective electrically conductive layers 67*a* and 67*b*, which face to each other.

The connector 74 is a first engaging element provided on the circuit board 65. The connector 75 is a second engaging element that is provided on the circuit board 68 and removably engages with the connector 74. The respective electrically conductive layers 67*a* and 67*b* of the circuit board 65 are fed with a high frequency signal from the oscillation circuit 71 in the facing area C1. Also, the respective electrically conductive layers 69*a* and 69*b* of the circuit board 68 are fed with the high frequency signal from the oscillation circuit 71 through the connectors 74 and 75. That is, the high frequency signal from the oscillation circuit 71 is fed to the respective circuit boards 65 and 68 in locations where the electrically conductive layers face to each other.

We here assume that the circuit area including the electrically conductive layer 69*a* on the circuit board 68 is formed in the circuit area including the electrically conductive layer 67*a* on the circuit board 65, and the circuit area including the electrically conductive layer 69*b* on the circuit board 68 is formed in the circuit area including the electrically conductive layer 67*b* on the circuit board 65. We also assume that the connectors 74 and 75 make connections between the electrically conductive layers 69*a* and 67*a* and between the electrically conductive layers 69*b* and 67*b*.

FIGS. 17 to 19 are plan views illustrating the configuration example of the microphone device 60 in FIG. 15. In FIG. 17, an appearance upon engagement of the respective circuit boards 65 and 68 is illustrated. Also, in FIG. 18, the connector 74 provided on the circuit board 65 is illustrated, and in FIG. 19, the connector 75 provided on the circuit board 68 is illustrated.

The connector 74 is a female part having an engagement hole 74*b* into which a convex part 75*b* of the connector 75 is to be inserted. On inner faces of the engagement hole 74*b*, two electrode arrays each including a plurality of terminal electrodes 74*a* arranged in a direction intersecting the x-axis direction, in this example, in the y-axis direction are arranged. The respective electrode arrays are arranged on the opposed faces spaced in the x-axis direction.

The connector 75 is a male part having the convex part 75*b* to be inserted into the engagement hole 74*b* of the connector 74. On side faces of the convex part 75*b*, two electrode arrays each including a plurality of terminal electrodes 75*a* arranged in a direction intersecting the x-axis direction, in this example, in the y-axis direction are arranged. The respective electrode arrays are arranged on the side faces spaced in the x-axis direction.

According to the present embodiment, the respective circuit boards 65 and 68 are electrically connected each other in the location where the electrically conductive layers in the two circuit areas face to each other, so that currents fed from the oscillation circuit 71 flow in the same direction between the circuit boards, and therefore can be suppressed from being electromagnetically cancelled each other. Also the high frequency signal is fed to the respective circuit areas of the circuit board 68 through the respective electrode arrays of the connectors 74 and 75, and therefore the circuit board 68 can be made to appropriately act as the antenna elements of the dipole antenna.

Note that, in the present embodiment, there is descried as an example the case where the electrically conductive layer 69*a* in the circuit board 68 and that 67*a* in the circuit board 65 are electrically connected to each other, and the electrically conductive layers 69*b* and 67*b* are electrically connected to each other; however, the present invention is not limited to this. For example, a part of the circuit board 68 may be made to function as the antenna element by electrically connecting any one of the electrically conductive layers in the two circuit areas of the circuit board 68 to the electrically conductive layer in the circuit board 65.

FIGS. 20 (*a*) and (*b*) are diagrams illustrating an example of operations for a case where the respective circuit areas of the circuit board 68 are made to function as the antenna elements of the dipole antenna along with the circuit board 65. In FIG. 20 (*a*), the microphone device 60 in which the two circuit areas of the circuit board 68 are made to function as the antenna elements is illustrated. Also, in FIG. 20 (*b*), a microphone device 80 in which any one of the two circuit areas of the circuit board 68 is made to function as the antenna element is illustrated.

The electrically conductive layers 69*a* and 69*b* of the circuit board 68 are isolated in terms of high frequency while being electrically conducted to each other, similarly to the respective electrically conductive layers 67*a* and 67*b* of the circuit board 65. That is, the respective electrically conductive layers 69*a* and 69*b* are common ground or power supply layers for circuit elements on the circuit board 68, and also independent as the antenna elements.

In the microphone device 60, the electrically conductive layers 69*a* and 67*a* are electrically connected to each other, as well as the electrically conductive layers 69*b* and 67*a* are electrically connected to each other, and the high frequency signal from the oscillation circuit 71 is fed to the respective electrically conductive layers 69*a* and 69*b*. The electrical connections between these electrically conductive layers are made without through any high frequency isolation element. That is, the electrically conductive layers 69*a* and 67*a* function as the common antenna element, as well as the electrically conductive layers 69*b* and 67*b* also function as the common antenna element, and therefore the two circuit areas of the circuit board 68 are used as the antenna elements of the dipole antenna.

On the other hand, in the microphone device 80, any one of the electrically conductive layers 69*a* and 69*b* of the circuit board 68 is only electrically connected to the electrically conductive layer in the circuit board 65, and the electrically conductive layer 69*b* is adapted not to be fed with the high frequency signal from the oscillation circuit 71. In this example, the electrically conductive layers 69*a* and 67*a* are electrically connected to each other. That is, the electrically conductive layers 69*a* and 67*a* function as the common antenna element, and the circuit area including the electrically conductive layer 69*a* of the two circuit areas of the circuit board 68 is used as the antenna element.

As described above, by using any one of the two circuit areas of the circuit board 68 that is arranged with facing to the circuit board 65 as the antenna element, the function of the circuit board 65 as the antenna can be assisted, and therefore the radiation characteristics of the dipole antenna can be improved. In the case where any one of the two circuit areas of the circuit board 68 is only used as the antenna element, the antenna element common to the electrically conductive layer 67*a* that is short in an x-axial length as compared with the electrically conductive layer 67*b* can be expanded, and therefore the circuit area including the electrically conductive layer 69*a* on the side opposite to the battery 66 and the oscillation circuit 71 is preferably used as the antenna element.

BRIEF DESCRIPTION OF THE DRAWINGS

FIG. 1 is a perspective view illustrating an example of a schematic configuration of a wireless microphone device according to a first embodiment of the present invention, in which a two-piece type microphone device 1 is illustrated.

FIG. 2 is a plan view illustrating a configuration example in a main part of the microphone device 1 in FIG. 1, in which the circuit board 5 sectioned into two circuit areas 11*a* and 11*b* is illustrated.

FIG. 3 is a cross-sectional view illustrating a configuration example in the circuit board 5 of FIG. 2, in which a cross-sectional appearance cut along an A1-A1 line on the feeding path is illustrated.

FIG. 4 is a diagram illustrating the configuration example in the circuit board 5 of FIG. 2, in which an appearance of the metal case 12 that is arranged on the circuit board 5 and viewed from the y-axis direction is illustrated.

FIG. 5 is a plan view illustrating the configuration example in the circuit board 5 of FIG. 2, in which soldered parts 26*a* and 26*b* of the metal case 12 are illustrated.

FIG. 6 is a diagram illustrating an example of operations of the microphone device 1 in FIG. 1, which is compared with a conventional example.

FIG. 7 is a plan view illustrating another configuration example in the main part of the microphone device 1 in FIG. 1, in which two circuit boards 111 and 112 made to function as an antenna are illustrated.

FIG. 8 is a plan view illustrating still another configuration example in the microphone device 1 of FIG. 1, in which the circuit board 5 of which terminal electrodes 121*a* and 121*b* are arranged on the circuit area 11*a* side is illustrated.

FIG. 9 is a diagram illustrating an example of a configuration inside a conventional wireless microphone device, in which a dipole antenna 100 using two electrical circuits 101 and 102 as elements respectively is illustrated.

FIG. 10 is a cross-sectional view illustrating the configuration example of the microphone device 1 in FIG. 2, in which a cross-sectional appearance that is cut along an A4-A4 line and vertical to the x-axis direction is illustrated.

FIG. 11 is a cross-sectional view illustrating the configuration example of the microphone device 1 in FIG. 2, in which a cross-sectional appearance that is cut along an A5-A5 line and vertical to the y-axis direction is illustrated.

FIG. 12 is a cross-sectional view illustrating a configuration example of a microphone device 40 according to a second embodiment of the present invention.

FIG. 13 is a plan view illustrating the configuration example of the microphone device 40 in FIG. 12, in which an appearance of circuit areas 11*a* and 11*b* that are formed with arrangement areas A7 being excluded is illustrated.

FIG. 14 is a cross-sectional view illustrating another configuration example in the microphone device according to the second embodiment of the present invention.

FIG. 15 is an appearance diagram illustrating a schematic configuration of a wireless microphone device according to a third embodiment of the present invention, in which a hand-held type microphone device 60 is illustrated.

FIG. 18 is a plan view illustrating the configuration example of the microphone device 60 in FIG. 15, in which the connector 74 provided on the circuit board 65 is illustrated.

FIG. 19 is a plan view illustrating the configuration example of the microphone device 60 in FIG. 15, in which the connector 75 provided on the circuit board 68 is illustrated.

FIG. 20 is a diagram illustrating an example of operations for a case where the respective circuit areas of the circuit board 68 are made to function as the antenna elements of the dipole antenna along with the circuit board 65.

DESCRIPTION OF REFERENCE NUMERALS

Figure 16:
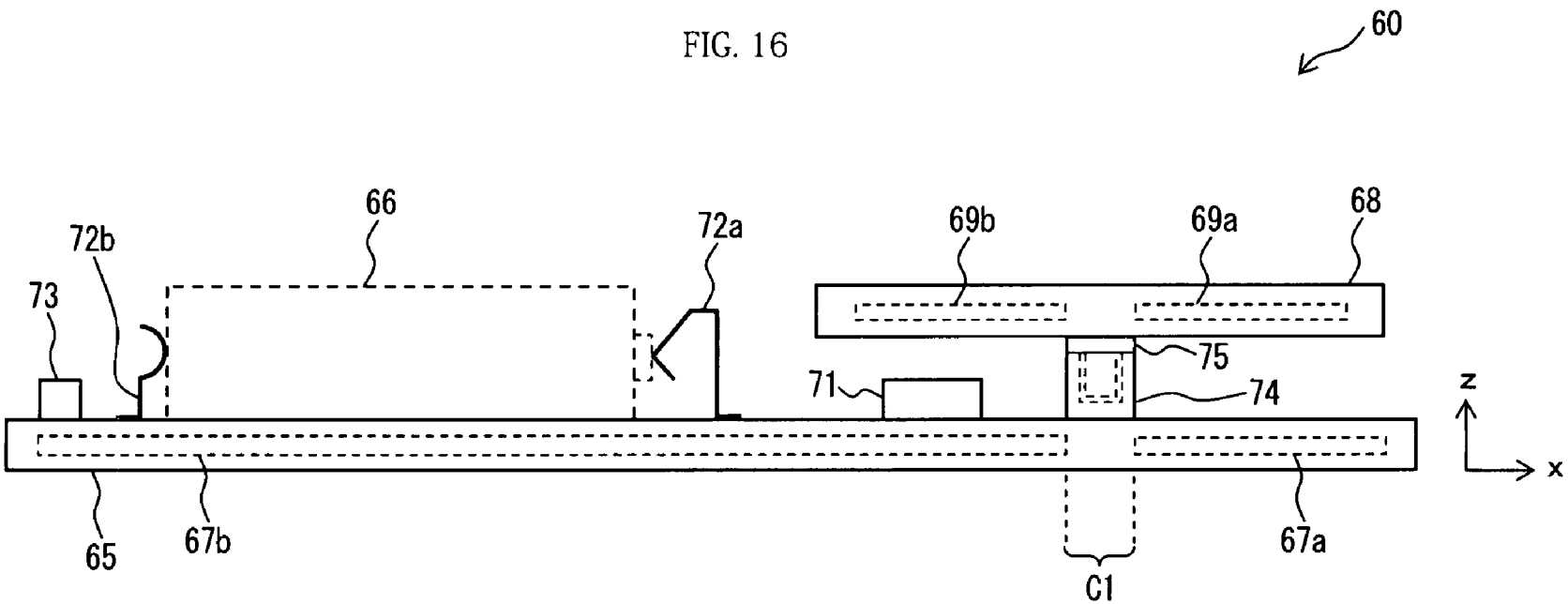
FIG. 16 is a diagram illustrating a configuration example in a main part of the microphone device 60 in FIG. 15, in which circuit boards 65 and 68 made to function as antenna elements are illustrated.
Figure 17:
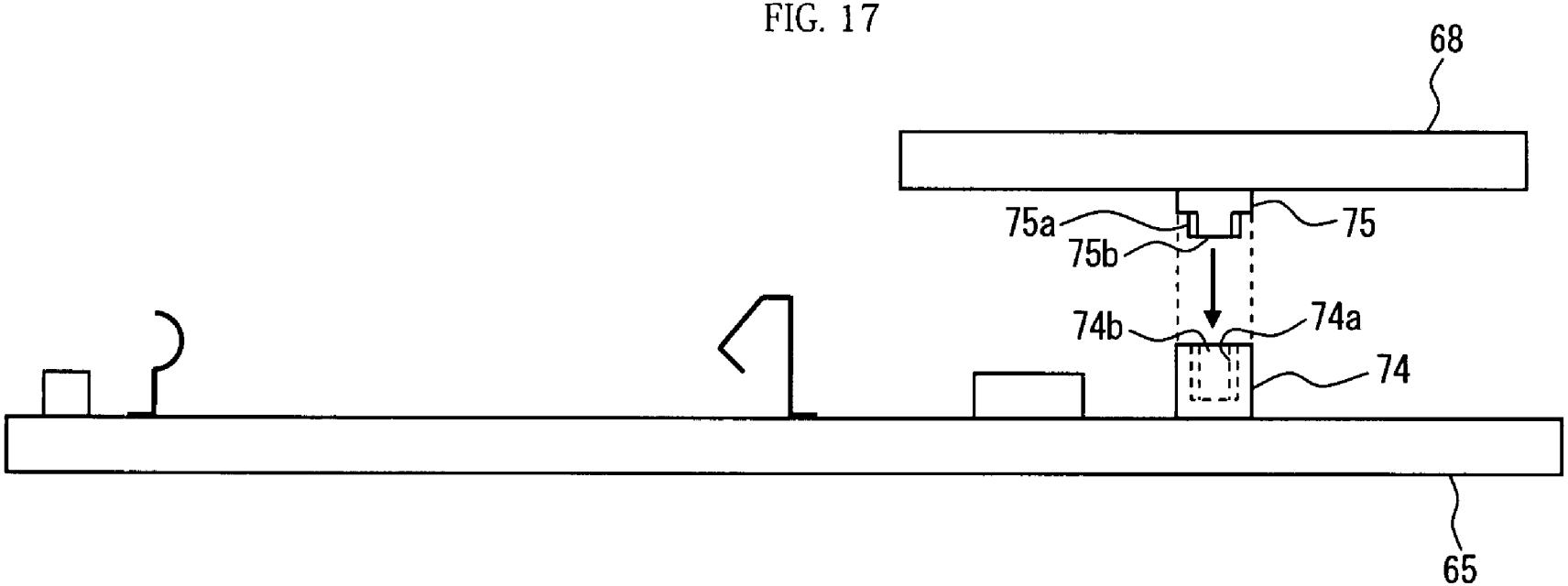
FIG. 17 is a plan view illustrating the configuration example of the microphone device 60 in FIG. 15, in which an appearance upon engagement of the respective circuit boards 65 and 68 is illustrated.

1 Microphone device
2 Microphone unit
2*a* Microphone
3 Transmission cable
4 Transmitter unit
5 Circuit board
6 Battery
11 Electrically conductive layer
11*a*, 11*b* Circuit area
12 Metal case
12*a* Rectangular-shaped opening
13, 14*a*, 14*b* Connection circuit
15*a*, 15*b* Connecting terminal
16 High frequency choke circuit
17 Battery containing part
21 Oscillation circuit
22 Amplifier circuit
23 Band-limiting filter circuit
24 feeding lines
25 Through-hole
26*a*, 26*b* Soldered part
31, 34 Other end of the terminal electrode
32, 35 One end of the terminal electrode
33 Wiring pattern
40, 50 Microphone device
51 Terminal electrode
52 Connection circuit
52*a*, 52*b* Connecting terminal
60 Microphone device
61 Wind screen
62 Transmitter main body
63 Microphone
64 Transmission cable
65, 68 Circuit board
66 Battery
67*a*, 67*b*, 69*a*, 69*b* Electrically conductive layer
71 Oscillation circuit
72*a*, 72*b* Connecting terminal
73~75 Connector
A7 Arrangement area
A8 One end of the terminal electrode

What is claimed is:

1. A wireless microphone device comprising:

a circuit board that is sectioned into a first circuit area and a second circuit area and makes the respective circuit areas function as antenna elements of a dipole antenna;

an oscillation circuit that is arranged in said first circuit area and generates a high frequency signal on a basis of a voice signal from a sound collecting element;

a feeding path configured to feed said high frequency signal to an electrically conductive layer in said first circuit area through a feeding point positioned on a second circuit area side of said first circuit area; and a high frequency shield covering at least a part of said feeding path, wherein said high frequency shield is formed by covering said feeding path with a metal case having an opening at a bottom face and conducting said metal case to the electrically conducting layer in said first circuit area.

2. The wireless microphone device according to claim 1, wherein said feeding path is provided with an amplifier circuit configured to amplify said high frequency signal and a band-limiting filter for limiting a frequency band of the high frequency signal amplified by said amplifier circuit; and said metal case contains said oscillation circuit, said amplifier circuit, and said band-limiting filter.

3. The wireless microphone device according to claim 1, wherein said feeding path is disposed on or above said circuit board; and said high frequency shield covers at least a part of said feeding path where a feeding direction of said high frequency signal on said feeding path is opposite from a feeding direction of said high frequency signal on said circuit board.

4. The wireless microphone device according to claim 3, wherein said high frequency shield includes said metal case and said electrically conductive layer configured to prevent said high frequency signal flowing through said feeding path and said high frequency signal flowing through said electrically conductive layer from interfering with each other.

5. The wireless microphone device according to claim 1, wherein said opening in said metal case is configured to allow said feeding path to go through.

6. The wireless microphone device according to claim 1, wherein said first circuit area is formed of an L-shape.

7. The wireless microphone device according to claim 1, wherein said second circuit area is formed of a rectangular shape.

8. The wireless microphone device according to claim 1, wherein said band-limiting filter, said amplifier circuit, and said oscillation circuit are located in the order closest to said feeding point.

9. A method of working a circuit board as a dipole antenna for use in said wireless microphone device according to claim 1, said method comprising:

dividing said circuit board into said first circuit area and said second circuit area;

placing said oscillation circuit in said first circuit area, said oscillation circuit converting a voice signal to a high frequency signal;

arranging said feeding path configured to feed said high frequency signal to said electrically conductive layer in said first circuit area through said feeding point disposed on said second circuit area of said first circuit area;

covering at least a part of said feeding path with said metal case having said opening at said bottom face; and conducting said metal case to said electrically conductive layer in said first circuit area.

10. The method of working a circuit board as a dipole antenna for use in the wireless microphone device according to claim 9, wherein said covering includes said opening in said metal case configured to allow said feeding path to go through.

11. The method of working a circuit board as a dipole antenna for use in the wireless microphone device according to claim 9, wherein said first circuit area is formed of an L-shape.

12. The method of working a circuit board as a dipole antenna for use in the wireless microphone device according to claim 9, wherein said second circuit area is formed of a rectangular shape.

13. A wireless microphone device comprising:

a circuit board that is sectioned into a first circuit area and a second circuit area and makes the respective circuit areas function as antenna elements of a dipole antenna;

an oscillation circuit that is arranged in said first circuit area and generates a high frequency signal on a basis of a voice signal from a sound collecting element;

a feeding path configured to feed said high frequency signal to an electrically conductive layer in said first circuit area through a feeding point positioned on a second circuit area side of said first circuit area;

a high frequency shield covering at least a part of said feeding path; and a high frequency isolation element configured to connect said first circuit area and said second circuit area electrically, and configured to pass a signal having a frequency lower than a frequency of said high frequency signal.

14. A wireless microphone device comprising:

a first circuit board and a second circuit board that are arranged with end faces facing to each other and made to function as antenna elements of a dipole antenna;

an oscillation circuit that is provided on a main face of said first circuit board and generates a high frequency signal on a basis of a voice signal from a sound collecting element;

a feeding path configured to feed said high frequency signal to an electrically conductive layer of said first circuit board through a feeding point positioned on a second circuit board side of said end face of said first circuit board; and a high frequency shield covering at least a part of said feeding path, wherein said high frequency shield is formed by covering said feeding path with a metal case having an opening at a bottom face and conducting said metal case to the electrically conducting layer in said first circuit board.

15. The wireless microphone device according to claim 14, wherein said opening in said metal case is configured to allow said feeding path to go through.

16. The wireless microphone device according to claim 14, wherein said first circuit board is formed of an L-shape.

17. The wireless microphone device according to claim 14, wherein said second circuit board is formed of a rectangular shape.

* * * * *